US008103185B2

(12) United States Patent
Chiba et al.

(10) Patent No.: US 8,103,185 B2
(45) Date of Patent: Jan. 24, 2012

(54) CLEANING DEVICE AND IMAGE FORMING APPARATUS

(75) Inventors: Satoshi Chiba, Suwa (JP); Koichi Kamijo, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 260 days.

(21) Appl. No.: 12/567,511

(22) Filed: Sep. 25, 2009

(65) Prior Publication Data

US 2010/0098470 A1 Apr. 22, 2010

(30) Foreign Application Priority Data

Oct. 16, 2008 (JP) ..... 2008-267150

(51) Int. Cl.
*G03G 15/16* (2006.01)

(52) U.S. Cl. ..... 399/101

(58) Field of Classification Search ..... 399/99, 399/101, 102, 123, 238, 245, 249, 283, 326, 399/345, 348, 350
See application file for complete search history.

(56) References Cited

U.S. PATENT DOCUMENTS 5,884,124 A * 3/1999 Karakama et al. ..... 399/123
7,444,093 B2 * 10/2008 Abe et al. ..... 399/57
2005/0074264 A1 * 4/2005 Amemiya et al. ..... 399/346

FOREIGN PATENT DOCUMENTS

JP 2001-166611 6/2001

* cited by examiner

*Primary Examiner* — Kiho Kim
(74) *Attorney, Agent, or Firm* — DLA Piper LLP (US)

(57) ABSTRACT

A cleaning device includes: a cleaning blade which removes liquid developer including toner particles and carrier liquid by bringing a contact corner portion constituted by a first surface and a second surface into contact with a cleaned body which is rotated or circulated while holding the liquid developer; a blade supporting body which supports the cleaning blade at the first surface of the cleaning blade or a surface on the side opposite to the first surface; a pressing member which presses the contact corner portion of the cleaning blade against the cleaned body; and seal members disposed at side ends in the first direction of the cleaning blade and having projecting portions which project further than the second surface on the side opposite to a third surface which is on the side opposite to the second surface.

8 Claims, 20 Drawing Sheets

CLEANING DEVICE AND IMAGE FORMING APPARATUS

BACKGROUND

1. Technical Field

The present invention relates to a cleaning device used in an image forming apparatus which uses a liquid developer including toner particles and carrier liquid, and an image forming apparatus provided with such a cleaning device.

2. Related Art

As an image forming apparatus which uses a liquid developer, for example, an apparatus is disclosed which has a photo conductor drum on which a latent image is formed, a developing device (developing section) which forms an image on the photo conductor drum by developing the latent image by the liquid developer, a primary transferring member which primarily transfers the image on the photo conductor drum to the image supporting surface of a circulating intermediate transferring belt (image supporting body), and a secondary transferring roller which comes into contact with the image supporting surface with a recording material (recording medium) interposed therebetween, thereby transferring the image transferred to the image supporting surface to the recording material (referring to FIG. 1, etc. of JP-A-2001-166611).This type of image forming apparatus has a number of rotating or circulating members (a latent image supporting body, a primary transferring roller, a secondary transferring roller, and the like; hereinafter referred to as holding members) which have holding surfaces that hold the liquid developer. Then, the liquid developer is removed from the holding surface by bringing a contact corner portion (edge portion) of a cleaning blade into contact with the holding surface of the holding member.

Here, the cleaning blade applied to the holding member (for example, the secondary transferring roller) has the contact corner portion constituted at the joining portion (ridge line) of one end surface (hereinafter referred to as a "contact side end surface") and a surface facing the outer circumferential surface of the holding member. Further, the cleaning blade is supported on a blade supporting body which is disposed so as to be able to be rocked with a given rocking shaft as a base, and the contact corner portion is brought into contact with the holding surface of the holding member in a pressed state by pressing the blade supporting body by a spring (pressing member). Then, the contact corner portion which is in a pressed state scrapes off unnecessary liquid developer and the like from the holding surface.

However, in this type of cleaning device, unbalance may occur in the contact pressure of the cleaning blade with a cleaned body (namely, the holding member). For example, in a case where the spring for applying a pressing force (biasing force) to the above-mentioned blade supporting body is mounted on the central portion along the shaft center of the blade supporting body, if deviation (for example, deviation within a manufacturing tolerance) occurs in the attaching position of the spring or in the shaft center of the blade supporting body, when the cleaning blade has been brought into contact with the cleaned body, unbalance may occur between the contact pressure of one end portion side of the cleaning blade with the cleaned body and the contact pressure of the other end portion side of the cleaning blade with the cleaned body.

In such a case, unforeseen inclination from one end portion side of the contact corner portion toward the other end portion side is generated, so that liquid developer collected in a region (hereinafter referred to as a "retention portion") surrounded by the outer circumferential surface and the contact side end surfaces of the cleaned body may be possibly biased to and distributed at a region located on one end portion side or the other end portion side of the contact corner portion in the retention portion. In this case, the liquid developer in the retention portion may drop across one end portion side or the other end portion side of the contact corner portion, thereby contaminating the inside of the image forming apparatus.

SUMMARY

An advantage of some aspects of the invention is that it allows liquid developer to be easily retained in a retention portion provided between a cleaned body and a cleaning blade, even in a case where unbalance may occur in the contact pressure of the cleaning blade with the cleaned body.

According to a first aspect of the invention, there is provided a cleaning device including: a cleaning blade which removes liquid developer including toner particles and carrier liquid by bringing a contact corner portion constituted by a first surface and a second surface into contact with a cleaned body which is rotated or circulated while holding the liquid developer; a blade supporting body which supports the cleaning blade at the first surface of the cleaning blade or a surface on the side opposite to the first surface; a pressing member which presses the contact corner portion of the cleaning blade against the cleaned body; and seal members disposed at side ends in the first direction of the cleaning blade and having projecting portions which project further than the second surface on the side opposite to a third surface which is on the side opposite to the second surface. In the invention, as the cleaned body, other than a roller member such as a secondary transferring roller, a photo conductor drum, a squeeze roller, or a cleaning roller, a belt member such as an intermediate transferring belt, or the like can be given as an example.

In the cleaning device, the pressing member may also press the blade supporting body at the central portion or the approximately central portion in the first direction of the cleaning blade. Further, the pressing members may also press the blade supporting body at the side ends or around the side ends in the first direction of the cleaning blade. Further, the projecting portions of the seal members may also have extension portions which extend in the first direction of the second surface from the side end portions of the cleaning blade toward the central portion of the cleaning blade.

According to a second aspect of the invention, there is provided an image forming apparatus including: an image supporting body which supports an image developed by liquid developer including toner particles and carrier liquid; a roller member which is brought into contact with or separated from the image supporting body; a driving source which is connected to one side end portion of the roller member so as to provide a driving force; and a cleaning section having a cleaning blade which removes the liquid developer by bringing a contact corner portion constituted by a first surface and a second surface into contact with the roller member, a blade supporting body which supports the cleaning blade at the first surface of the cleaning blade or a surface on the side opposite to the first surface, a pressing member which presses the contact corner portion of the cleaning blade against the roller member, and seal members disposed at side ends in the first direction of the cleaning blade and having projecting portions which project further than the second surface on the side opposite to a third surface which is on the side opposite to the second surface.

In the image forming apparatus, the seal member may also be disposed on the one end portion side on which the roller member is connected to the driving source. Further, the roller member may also be a transferring roller which transfers the image supported on the image supporting body to a recording material.

According to a third aspect of the invention, there is provided an image forming apparatus including: an image supporting body which supports an image developed by liquid developer including toner particles and carrier liquid; and a cleaning section having a cleaning blade which removes the liquid developer by bringing a contact corner portion constituted by a first surface and a second surface into contact with the image supporting body, a blade supporting body which supports the cleaning blade at the first surface of the cleaning blade or a surface on the side opposite to the first surface, a pressing member which presses the contact corner portion of the cleaning blade against the image supporting body, and seal members disposed at side ends in the first direction of the cleaning blade and having projecting portions which project further than the second surface on the side opposite to a third surface which is on the side opposite to the second surface.

According to the invention, even in a case where unbalance may occur in the contact pressure of the cleaning blade with the cleaned body, the liquid developer may be easily retained in a retention portion provided between the cleaned body and the cleaning blade.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, embodiments of the invention will be explained using the drawings.

Embodiment 1

Figure 1:
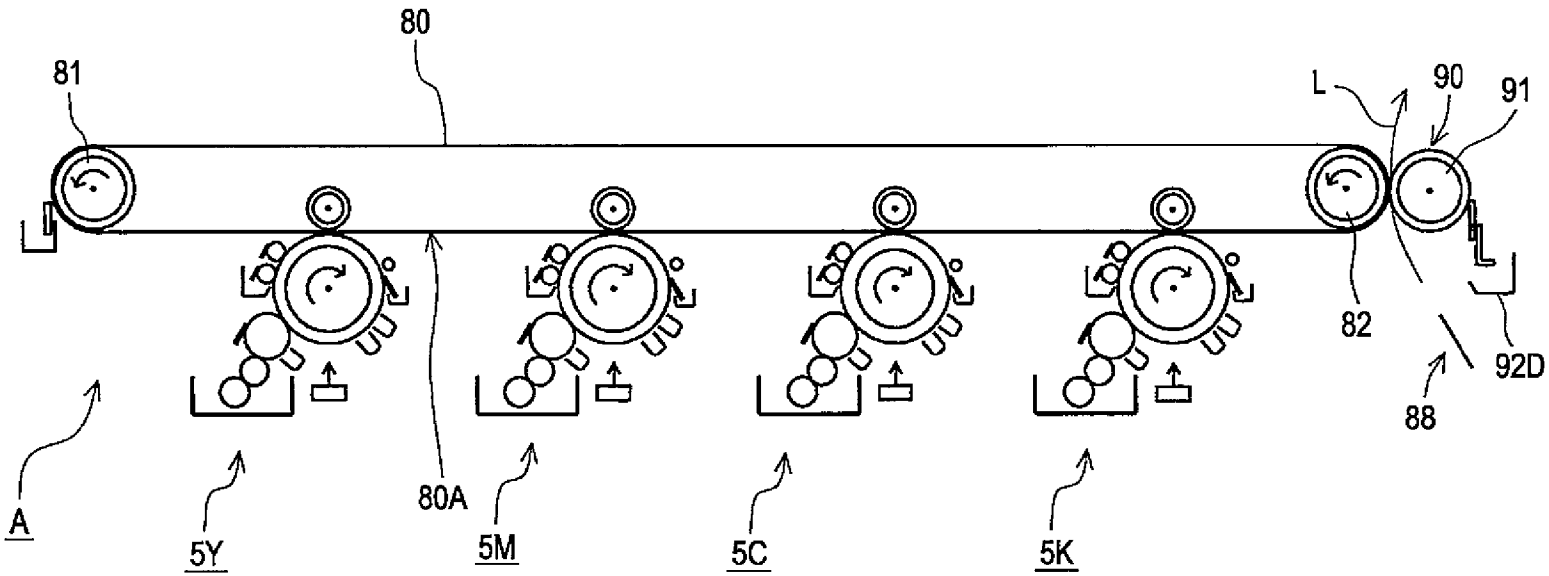
FIG. 1 is an explanatory view showing the main components constituting the image forming apparatus of Embodiment 1.
Figure 2:
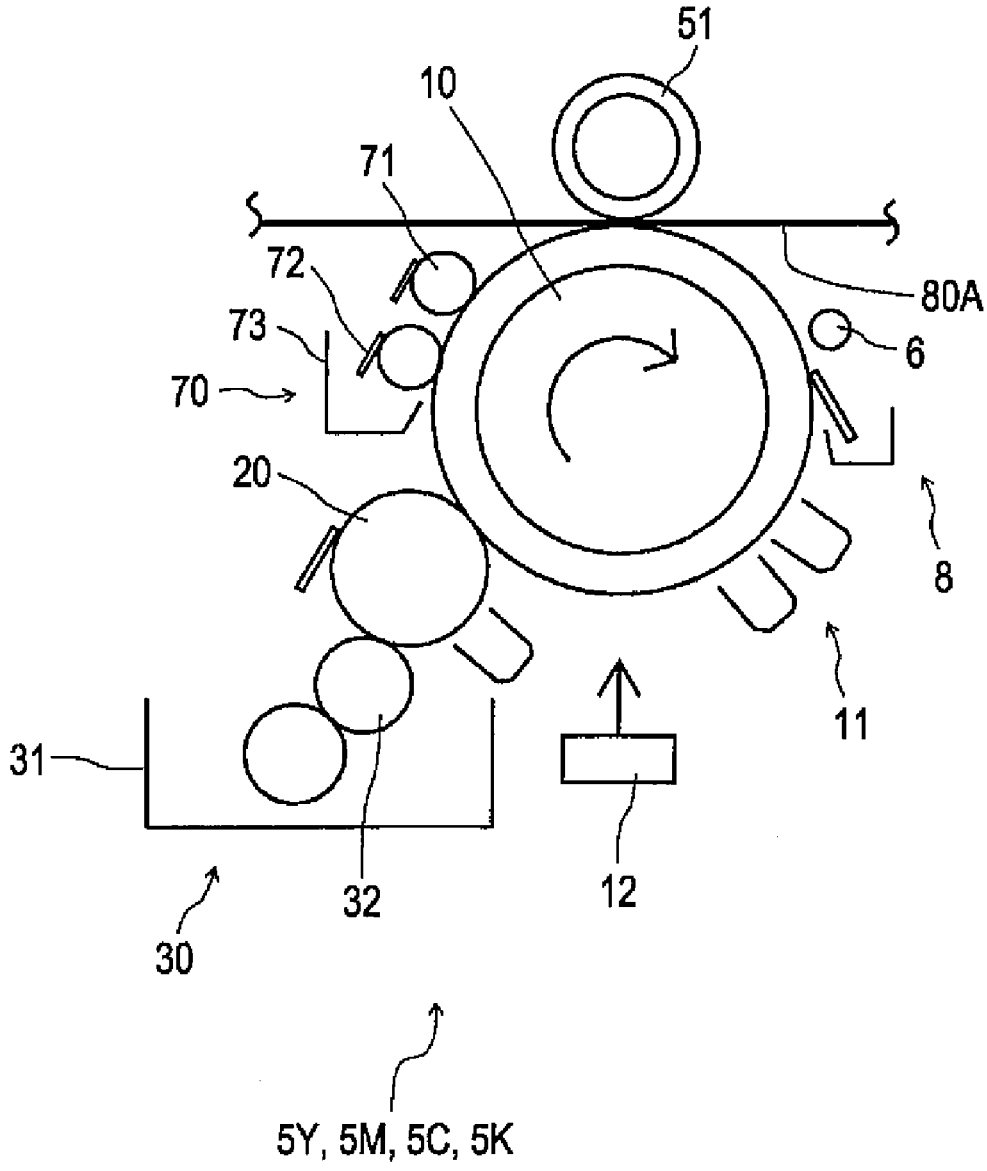
FIG. 2 is an enlarged view of a portion of FIG. 1.

First, the basic configuration of the image forming apparatus A of Embodiment 1 is explained using FIGS. 1 and 2. As shown in FIG. 1, the image forming apparatus A includes a total of four image forming stations 5Y, 5M, 5C, and 5K for yellow (Y), magenta (M), cyan (C), and black (K); an intermediate transferring belt 80; a first roller 81; a second roller 82; and a secondary transferring unit 90. Further, the image forming stations 5Y, 5M, 5C, and 5K are arranged in this order in a horizontal direction between the first roller 81 and the second roller 82.

As shown in FIG. 2, each of the image forming stations 5Y, 5M, 5C, and 5K includes a photo conductor drum 10, an electrifying member 11, an exposure unit 12, a developing unit 30, a photo conductor drum squeeze device 70, a primary transferring roller 51, a static elimination device 6, and a cleaning device 8. Each photo conductor drum 10 is constituted into a generally cylindrical shape and has a photosensitive layer formed on the outer circumferential surface thereof. The photo conductor drums have the same outer diameter (80 mm). Also, around the outer circumferential surface of each photo conductor drum, the electrifying member 11, the exposure unit 12, the developing unit 30, the photo conductor drum squeeze device 70, the primary transferring roller 51, the static elimination device 6, and the cleaning device 8 are arranged in this order (in this order along the rotation direction of the photo conductor drum 10). Further, the photosensitive layer of the photo conductor drum 10 is constituted of an image supporting body made of amorphous silicon.

Each electrifying member 11 is constituted by using a corona electrifier and applied with the bias of the same polarity as the electrifying polarity of liquid developer from a power supply device (not shown). Further, each electrifying member 11 serves to electrify the corresponding photo conductor drum 10. Also, each electrifying member 11 may also be constituted by an electrifying roller. Also, each exposure unit 12 serves to form a latent image on the corresponding photo conductor drum 10 by irradiating a light image from an LED head, a laser scanning optical system, or the like.

Each developing unit 30 includes a developing roller 20, a developer vessel 31 which stores the liquid developer of each color (Y, M, C, K), and a developer supply roller 32 which supplies the liquid developer from the developer vessel 31 to the developing roller 20. Further, the latent image formed on the corresponding photo conductor drum 10 is developed by the developing unit 30. Also, in this embodiment, as the developer which is accommodated in each developer vessel 31 in this manner, the liquid developer including toner particles and carrier liquid (nonvolatile liquid carrier) is used.

More specifically, the developer is not a volatile liquid developer of low concentration (about 1 to 2 wt %) and low viscosity using Isopar (brand mark: produced by Exxon Corp.) as the carrier liquid and having volatility at normal temperature, but a nonvolatile liquid developer of high concentration and high viscosity having non-volatility at normal temperature. That is, the liquid developer in this embodiment is a liquid developer of high viscosity (about 30 to 10000 mPa·S) in which a solid material of 1 μm average grain diameter having a coloring agent such as pigment dispersed in thermoplastic resin is added along with a dispersant to liquid solvent such as organic solvent, silicon oil, mineral oil, or edible oil and the toner solid content concentration is about 25%.

The photo conductor drum squeeze device 70 is disposed on the downstream side of the developing unit 30 along the rotation direction of the photo conductor drum 10 so as to collect the surplus of the developer on the photo conductor drum 10. The photo conductor drum squeeze device 70 includes two photo conductor squeeze rollers 71, cleaning blades 72 each disposed for each squeeze roller 71, and a collection vessel 73.

The photo conductor squeeze roller (diameter: 20 mm) 71 has a metallic base portion and a generally cylindrically shaped elastic portion (far example, urethane rubber) (thickness: 2.5 mm, hardness: JIS-30°, and electric resistance: $10^6$ Ωcm in volume resistance value in the application of 250 V) mounted into a generally cylindrical shape on the outer circumferential portion of the base portion. Further, the photo conductor squeeze roller 71 is rotated in the direction opposite to the rotation direction of the photo conductor drum 10 while being brought into sliding-contact with the photo conductor drum 10, thereby performing the removal of the carrier liquid from the photo conductor drum 10. Further, each cleaning blade 72 is constituted of an elastic body such as rubber and brought into pressure-contact with the corresponding squeeze roller 71, thereby scraping off and removing the carrier liquid remaining on the squeeze roller 71. Then, the collection vessel 73 acting as a collecting member collects the developer scraped off by each cleaning blade 72.

The first roller 81 and the second roller 82 are disposed at a given distance in a horizontal direction. Also, the intermediate transferring belt 80 is constituted into an endless shape and mounted in a tensioned state between the first roller 81 and the second roller 82 so as to be rotationally driven by the second roller 82, which constitutes a driving roller, thereby circulating between the first roller 81 and the second roller 82. Further, the first roller 81 also serves as a tension roller for imparting tension to the intermediate transferring belt 80.

The intermediate transferring belt 80 is a belt (belt width: 324 mm, thickness: 0.08 mm, and electric resistance: $10^{10}$ Ωcm in volume resistance value in the application of 250 V and $10^{11}$ Ω/□ in surface resistance) constituted of electrically conductive polyimide, and the outer circumferential surface thereof constitutes an image supporting surface (also being a holding surface) 80A. However, in place of the intermediate transferring belt 80, an intermediate transferring elastic belt (belt width: 324 mm, thickness: 290 μm, and electric resistance of all layers: $10^{10}$ Ωcm in volume resistance) may also be used in which a base material layer (thickness: 80 μm) constituted of electrically conductive polyimide, an elastic layer (thickness: 200 μm; JIS-A30°) constituted of urethane rubber, and a coat layer (thickness: 10 μm) constituted of fluorine series resin (such as PFA), fluorine series rubber, or the like are laminated in this order. Also, the intermediate transferring belt 80 constitutes a specific example of an image supporting body.

Each primary transferring roller (outer diameter: 30 mm) 51 is a so-called bias roller and is brought into contact with the photo conductor drum 10 with the intermediate transferring belt 80 interposed therebetween. Also, the primary transferring roller 51 has a metallic base portion and a generally cylindrically shaped surface layer portion (thickness: 5.0 mm, material: urethane rubber, hardness: JIS-30°, and electric resistance: $10^4$ Ωcm in volume resistance value in the application of 250 V) mounted into a generally cylindrical shape on the outer circumferential portion of the base portion. The primary transferring roller 51 is pressed toward the rotary shaft of the corresponding photo conductor drum 10 by a biasing means (such as a spring), thereby applying a certain load (primary transferring load: 5 kgf) to the intermediate transferring belt 80. Thus, if a bias is applied to each primary transferring roller 51, the developed toner image of each color attached to the photo conductor drum is transferred to the image supporting surface 80A of the intermediate transferring belt 80, so that a full color toner image (a full-color toner image or monochromatic toner image) is formed on the image supporting surface 80A of the intermediate transferring belt 80. Also, as a member performing the primary transfer, other than the transferring roller, a member having an electrode plate formed into a generally circular arc shape may also be given as an example.

The static elimination device 6 and the cleaning device 8 are disposed in this order on the downstream side of a primary transfer position of the primary transferring roller 51 in the rotation direction of the photo conductor drum 10. Further, the cleaning device 8 is a device for removing the developer, which remains on the photo conductor drum 10 without being transferred to the intermediate transferring belt 80 in the primary transfer process, from the photo conductor drum.

Figure 3:
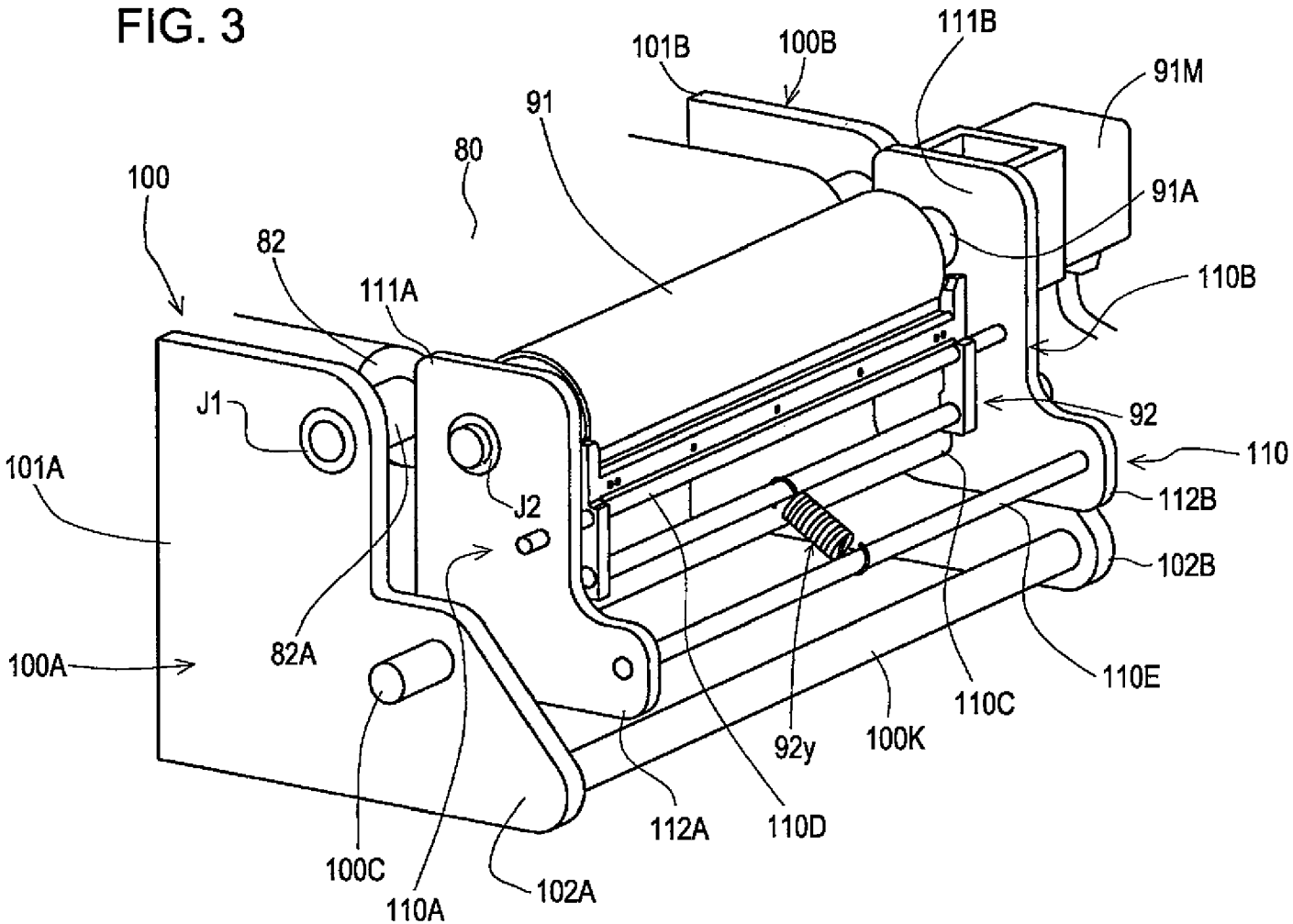
FIG. 3 is a perspective view for explaining the relations among a secondary transferring frame, a transferring frame, a secondary transferring roller, and a cleaning device (the position of the secondary transferring roller is a contact position).

The secondary transferring unit 90 includes a secondary transferring roller 91 disposed in a state where it can be brought into contact with the image supporting surface 80A of the intermediate transferring belt 80, and a cleaning device 92. Further, vertically below the cleaning device 92, a collection vessel 92D for collecting the liquid developer dropped from the cleaning device 92 is disposed. Also, the secondary transferring roller 91 and the cleaning device 92 are supported on a secondary transferring frame 110 so as to be able to be rocked. That is, as shown in FIG. 3, the image forming apparatus A includes a transferring frame 100 and the secondary transferring frame 110 which is supported on the transferring frame 100 so as to be able to be rocked in the inside of the transferring frame 100. Also, the transferring frame 100 has a pair of side plates 100A and 100B which are disposed approximately in parallel at a distance, and the secondary transferring frame 110 has a pair of side plates 110A and 110B which are disposed approximately in parallel at a distance in the inside of the transferring frame 100. Also, the secondary transferring roller 91 constitutes specific examples of a "cleaned body" and a "roller member", and the secondary transferring frame 110 constitutes a specific example of a "supporting main body".

Figure 4:
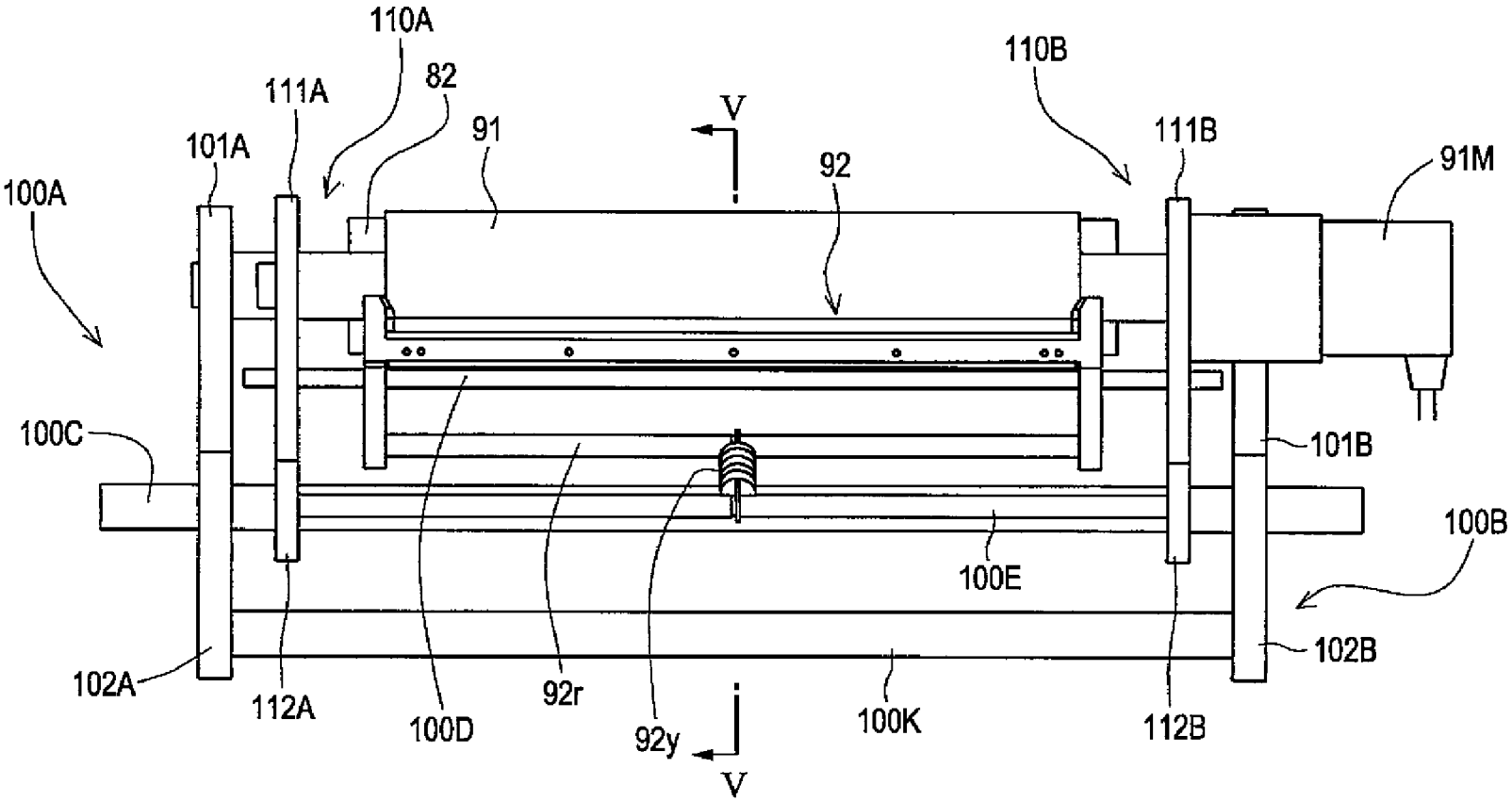
FIG. 4 is a side view for explaining the relations among the secondary transferring frame, the transferring frame, the secondary transferring roller, and the cleaning device (the position of the secondary transferring roller is a contact position).

The side plates 100A and 100B constituting the transferring frame 100 include side plate main bodies 101A and 101B and extension portions 102A and 102B which extend from the lower sides of one side end portion in the widthwise direction of the side plate main bodies 101A and 101B, as shown in FIGS. 3 and 4. Further, the side plates 110A and 110B constituting the secondary transferring frame 110 include side plate main bodies 111A and 111B and extension portions 112A and 112B which extend from the lower sides of one side end portions in the widthwise direction of the side plate main bodies 111A and 111B.

As shown in FIG. 3, bearing members J1 are embedded in the upper end sides of one side end portions in the widthwise direction of the side plate main bodies 101A and 101B constituting the transferring frame 100, and each end portion of a rotary shaft 82A of the above-mentioned second roller 82 is supported in a rotatable state on each bearing member J1. Also, each end portion of a rocking center shaft 100C is non-rotationally supported on each of the upper end sides of the intermediate portions along the extending direction of the extension portions 102A and 102B constituting the transferring frame 100. In addition, the rocking center shaft 100C is inserted into through-holes 110C formed in the lower end portions of the side plate main bodies 111A and 111B constituting the secondary transferring frame 110 (referring to FIG. 5). Therefore, the secondary transferring frame 110 is supported on the transferring frame 100 through the rocking center shaft 100C, and also can be rocked with the shaft center of the rocking center shaft 100C as a base. Further, a support shaft 100K is non-rotationally supported between the lower end sides of one side end portions in the widthwise direction of the extension portions 102A and 102B constituting the transferring frame 100.

As shown in FIG. 3, bearing members J2 are embedded in the upper end sides of the side plate main bodies 111A and 111B constituting the secondary transferring frame 110, and each end of a rotary shaft 91A of the secondary transferring roller 91 is supported in a rotatable state on each bearing member J2. Further, each end portion of a rocking center shaft 110D is non-rotationally supported on each of regions positioned at the vertically intermediate portions of one side end portions in the widthwise direction of the side plate main bodies 111A and 111B. Also, since the rocking center shaft 110D is inserted into through-holes 92*c* (referring to FIG. 5) formed in the cleaning device 92, the cleaning device 92 is supported by the secondary transferring frame 110 so as to be able to be rocked. Accordingly, as described above, the secondary transferring roller 91 and the cleaning device 92 are supported on the secondary transferring frame 110, and also can be rocked with the rocking center shaft 100C as a rocking shaft center. Further, a support shaft 110E is non-rotationally supported between the extension portions 112A and 112B of the secondary transferring frame 110. Further, a motor 91M for directly driving the rotary shaft 91A of the secondary transferring roller 91 is mounted on one side plate 110B constituting the secondary transferring frame 110. The motor 91M constitutes a specific example of a driving source of the roller member.

Figure 5:
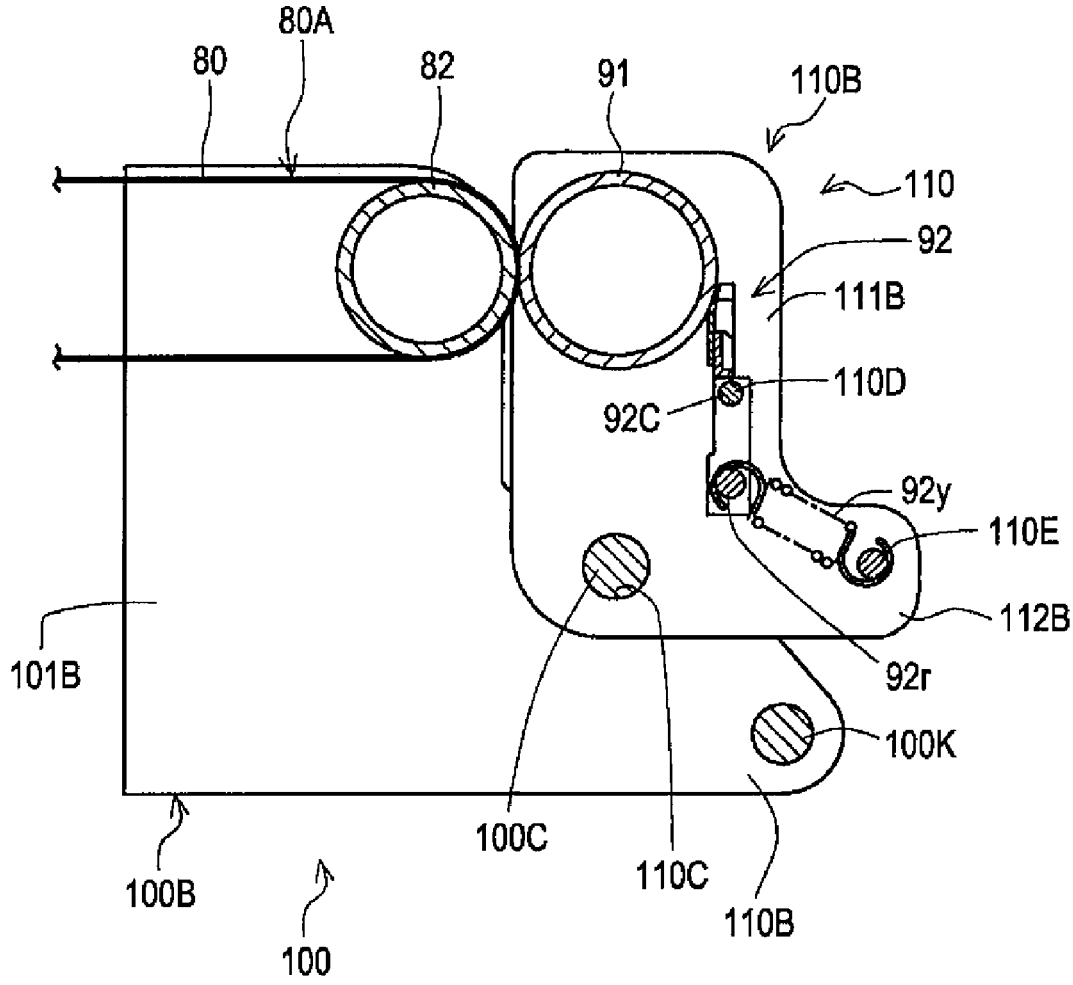
FIG. 5 is a cross-sectional view taken along line V-V of FIG. 4.

If the secondary transferring frame 110 is rotated in one rotation direction (the counter-clockwise direction in the drawing) with the rocking center shaft 100C as a base, the secondary transferring roller 91 is brought into contact with the second roller 82 with the intermediate transferring belt 80 interposed therebetween, as shown in FIGS. 3 to 5. Accordingly, the rotation amount in one rotation direction of the secondary transferring frame 110 is prohibited from being further increased. Further, in the following explanation, this position of the secondary transferring roller 91 is referred to as a "transfer position" or a "contact position". Additionally, as a mechanism for rotating the secondary transferring frame 110 in one rotation direction, namely, a contacting mechanism for bringing the secondary transferring roller 91 into contact with the image supporting surface 80A (holding surface) of the image supporting body (intermediate transferring belt 80), for example, a pressing member (such as a spring) (not shown) may be used. Further, in this embodiment, the pressing member (such as a spring) is mounted on one side plate 110B constituting the secondary transferring frame 110.

Figure 6:
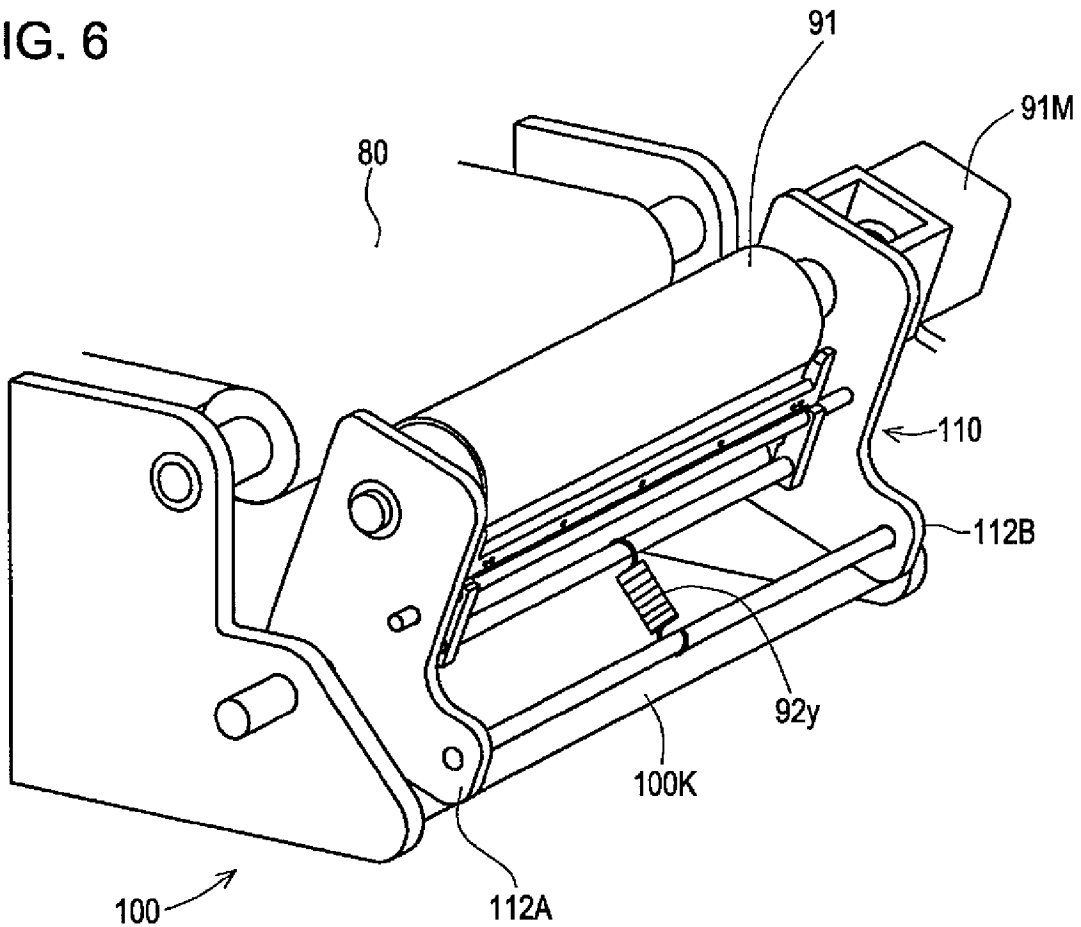
FIG. 6 is a perspective view for explaining the relations among the secondary transferring frame, the transferring frame, the secondary transferring roller, and the cleaning device (the position of the secondary transferring roller is a separated position).
Figure 7:
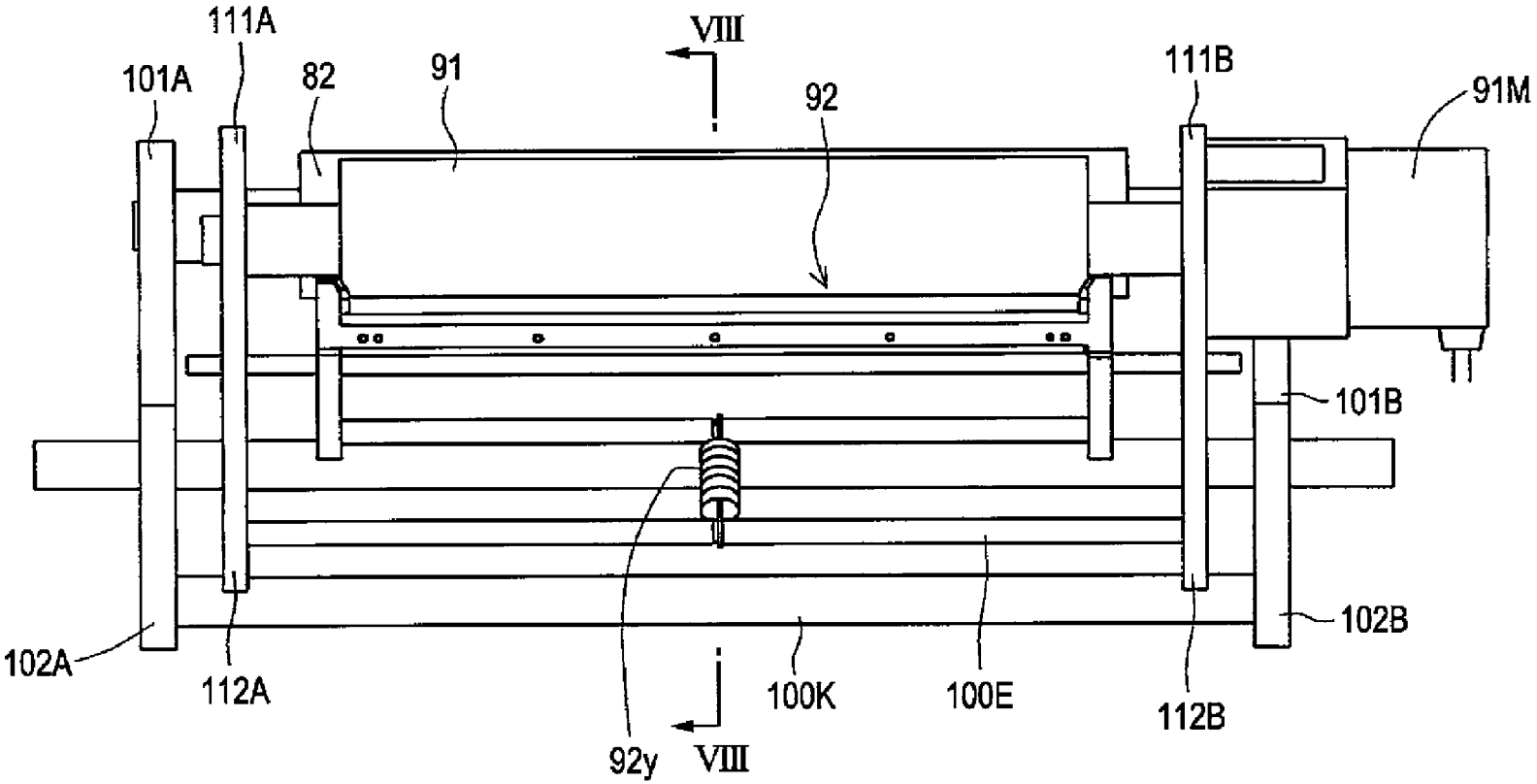
FIG. 7 is a side view for explaining the relations among the secondary transferring frame, the transferring frame, a main body frame, the secondary transferring roller, and the cleaning device (the position of the secondary transferring roller is a separated position).
Figure 8:
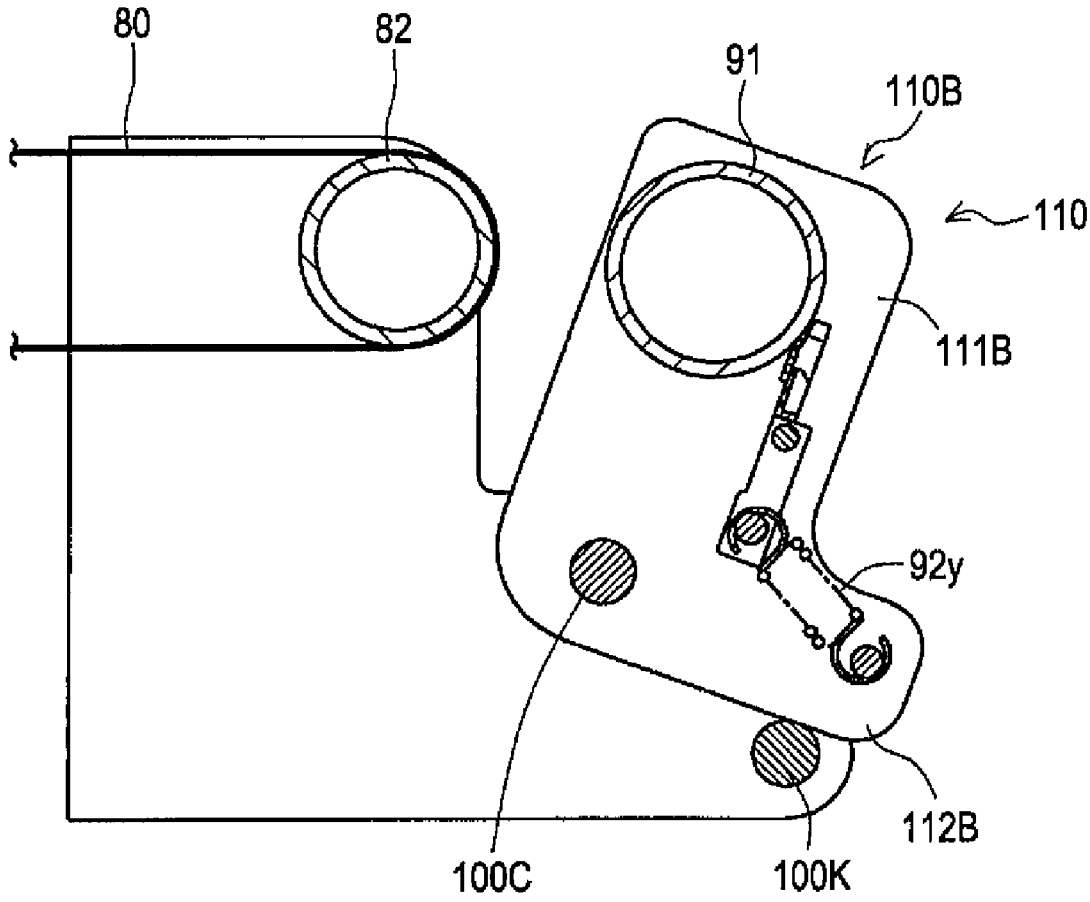
FIG. 8 is a cross-sectional view taken along line VIII-VIII of FIG. 7.

If the secondary transferring frame 110 in which the secondary transferring roller 91 is in the transfer position is rotated in the other direction (the clockwise direction in the drawing) with the rocking center shaft 100C as a base, the lower portions of the extension portions 112A and 112B are brought into contact with the support shaft 100K, as shown in FIGS. 6 to 8. Accordingly, the rotation amount in the other rotation direction of the secondary transferring frame 110 is prohibited from being further increased. At this time, the secondary transferring roller 91 reaches a position where it is separated from the intermediate transferring belt 80 (this position of the secondary transferring roller 91 is referred to as a "separated position"). Also, as a mechanism for moving the position of the secondary transferring roller 91 from the transfer position to the separated position, namely, a separating mechanism for separating the secondary transferring roller 91 from the image supporting surface 80A (holding surface) of the image supporting body (intermediate transferring belt 80), for example, a separating member (such as a cam) (not shown) may be used. Further, in this embodiment, the separating member (such as a cam) is mounted on one side plate 110B constituting the secondary transferring frame 110. Also, the separating member (such as a cam) constitutes a specific example of a support member which supports the secondary transferring frame 110 so that the secondary transferring roller 91 is in the separated position.

In this embodiment, the secondary transferring roller 91 and the cleaning device 92 are integrated (unitized) with the secondary transferring frame 110, so that they are integrally rocked in accordance with the rocking of the secondary transferring frame 110. Accordingly, the movement of the secondary transferring roller 91 and the movement of the cleaning device 92 do not need to be separately adjusted, but it is only required to regulate the rocking fulcrum point of the secondary transferring frame 110. Therefore, the simplification of the structure of the image forming apparatus A can be achieved.

The secondary transferring roller 91 is one for transferring an image formed on the image supporting surface 80A of the intermediate transferring belt 80 to a recording material (such as paper, film, or cloth) 88 (referring to FIG. 1). That is, when the secondary transferring roller 91 is in the transfer position (referring to FIGS. 3 to 5), the recording material (such as paper, film, or cloth) transported in a recording material transportation path L is transported between the secondary transferring roller 91 and the image supporting surface 80A, so that the image of the image supporting surface 80A is transferred to the recording material. Also, in a case where the second transfer is carried out in succession on the plural pieces of recording material, the secondary transferring roller 91 is in a state where it is always brought into contact with the intermediate transferring belt 80 with the recording material interposed therebetween. However, since the recording materials transported in succession cannot be arranged without gaps, the secondary transferring roller 91 and the intermediate transferring belt 80 are brought into direct contact with each other in the gap between the recording materials transported in succession, so that the liquid developer (image) on the image supporting surface 80A is transferred to the secondary transferring roller 91. Further, the image transferred to the recording material is fixed to the recording material by a fixing unit (not shown).

In a case where the second transfer is not carried out, the above-mentioned separating member (such as a cam) is driven, so that the secondary transferring frame 110 is rotated in the above-mentioned "other rotation direction" against the pressing force (such as biasing force) of the pressing member (such as a spring). Therefore, the position of the secondary transferring roller 91 becomes the separated position (referring to FIGS. 6 to 8), so that the secondary transferring roller 91 is in a state where it is separated from the intermediate transferring belt 80. Also, if the restriction of the secondary transferring frame 110 by the separating member (such as a cam) is removed by further driving the separating member (such as a cam), the secondary transferring frame 110 is rotated in "one rotation direction" by the pressing force (such as biasing force) of the pressing member (such as a spring), so that the position of the secondary transferring roller 91 is returned to the contacting position.

Figure 9:
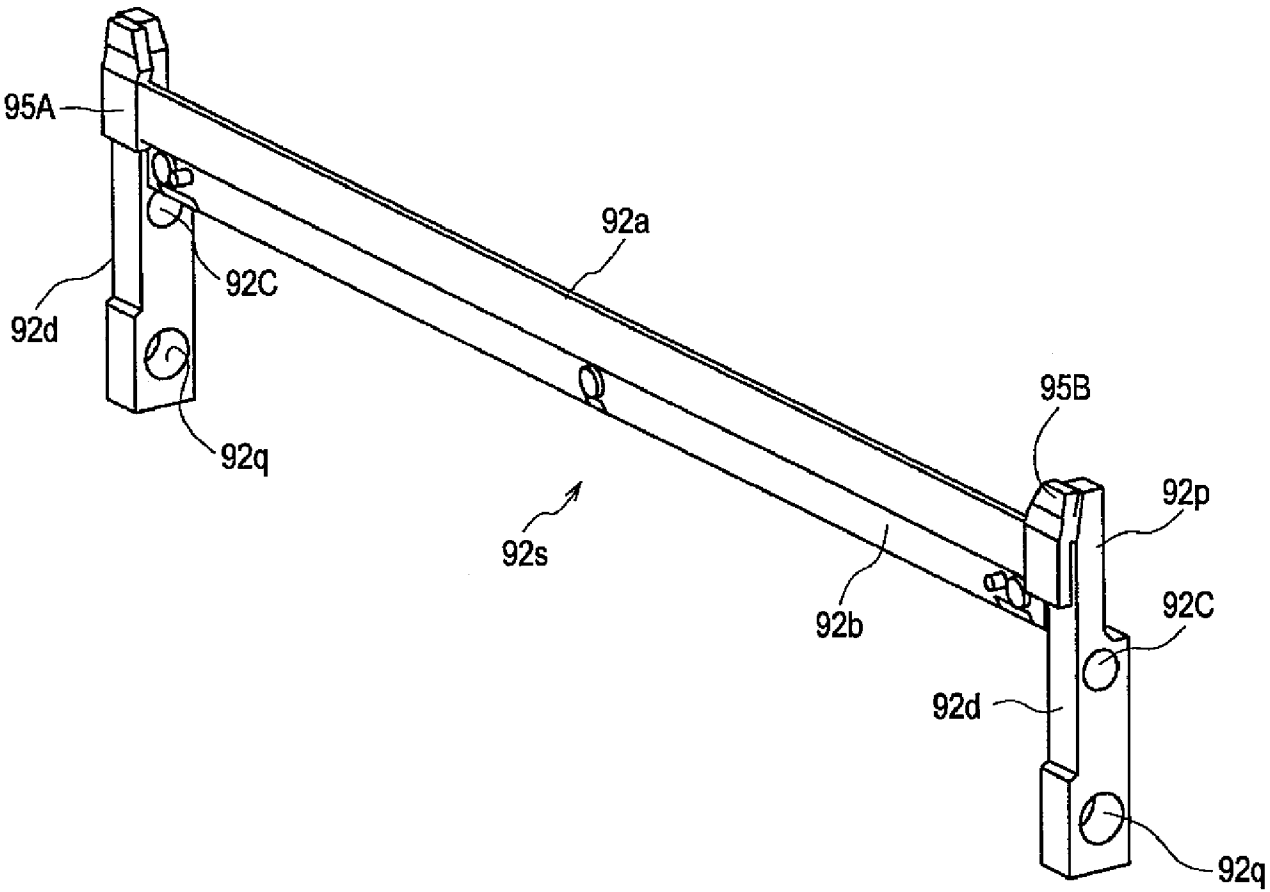
FIG. 9 is a perspective view showing the cleaning device of Embodiment 1.
Figure 10:
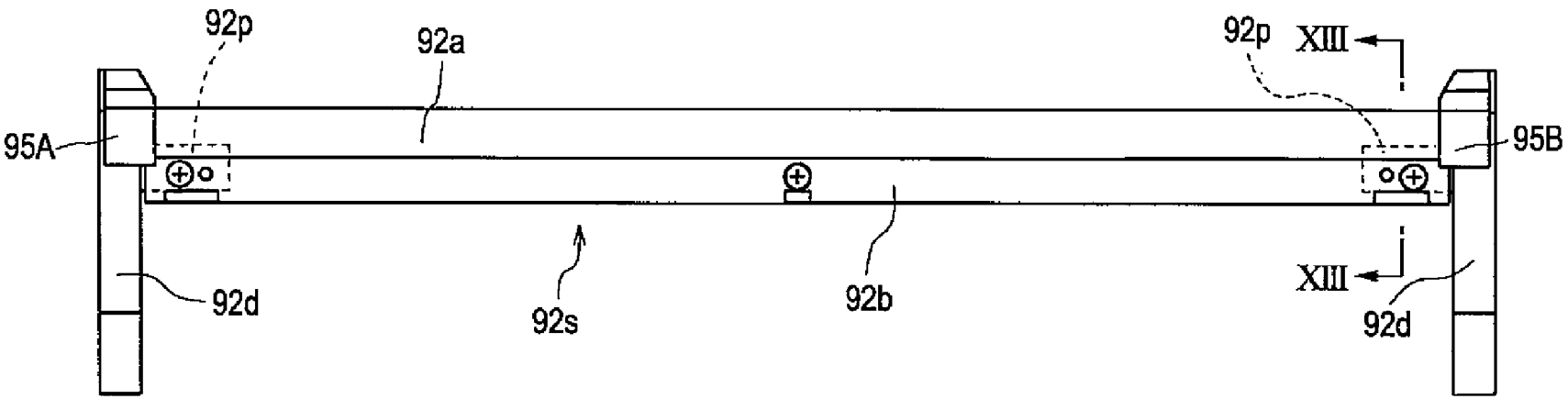
FIG. 10 is a front view showing the cleaning device of Embodiment 1.

The cleaning device 92 includes a cleaning blade 92*a*, a blade supporting body 92*s*, a pressing member 92*y* (referring to FIG. 3), and seal members 95A and 95B, as shown in FIGS. 9 and 10. Further, the blade supporting body 92*s* has a cleaning blade supporting plate 92*b* and cleaning frames 92*d* and 92*d*.

The cleaning blade 92*a* is constituted of an elongated plate-like body made of urethane rubber (for example, urethane rubber produced by the reaction of polyester polyol, such as polyethylene adipate, f-caprolactone ester polyol, or butylene adipate, and polyisocyanate). Also, as the constituent material of the cleaning blade 92*a*, fluoro-rubber, silicon rubber, chloroprene rubber, butadiene rubber, and the like can be given as an example. However, urethane rubber (polyurethane rubber) is more preferable as the constituent material of the cleaning blade 92*a* because it is particularly excellent in abrasion resistance.

Figure 11:
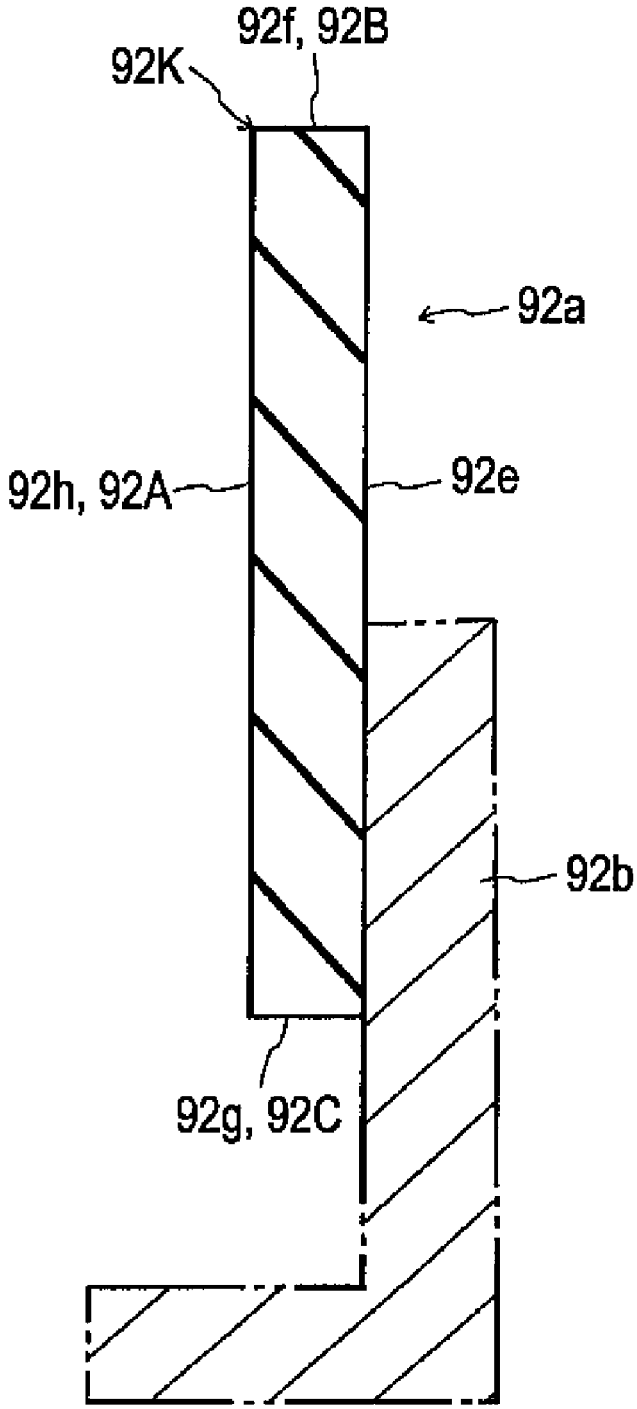
FIG. 11 is a schematic longitudinal sectional view of a cleaning blade.

The cleaning blade 92*a* can be manufactured, for example, as follows. An elongated strip-shaped substrate (urethane rubber) is shaped by pouring a forming material of urethane (polyurethane composition containing polyisocyanate and polyol) into a predefined shaping mold and performing so-called "centrifugal molding". Then, if the substrate is cut to a predetermined width by using a cutter or the like, the manufacture of the cleaning blade 92*a* is completed. Also, as shown in FIG. 11, the cleaning blade 92*a* has a surface (hereinafter referred to as a "mold contact surface") 92*e* which comes into contact with the inner wall surface of the shaping mold when the substrate (urethane rubber) is shaped, and end surfaces (hereinafter referred to as "cut surfaces") 92*f* and 92*g* formed by cutting the substrate. Also, the mold contact surface 92*e* is a surface which is parallel to the cleaning blade supporting plate 92*b* described later, and the cut surfaces 92*f* and 92*g* are surfaces which intersect with the mold contact surface 92*e*.

Here, if the contact angle when dropping pure water "0.5 uL" on each of the mold contact surface 92*e* and the cut surfaces 92*f* and 92*g* is measured by a "θ/2" method by using a measuring instrument (trade name: DROPMASTER, manufactured by Kyowa Interface Science Co., Ltd.), the contact angle in the mold contact surface 92*e* is 110° and the contact angle in each of the cut surfaces 92*f* and 92*g* is 80°. Therefore, in the cleaning blade 92*a*, the cut surfaces 92*f* and 92*g* are easily wetted with the liquid developer (have a lipophilic property), and the mold contact surface 92*e* is difficult to be wetted with the liquid developer (has oil repellency). Also, the surface roughness of the cleaning blade 92*a* is as follows. That is, the centerline average roughness Ra of the mold contact surface 92*e* becomes 0.01 un and the ten-point average roughness Rz becomes 0.07 un. Also, the centerline average roughness Ra of each of the cut surfaces 92*f* and 92*g* becomes 0.32 un and the ten-point average roughness Rz becomes 1.85 un. Therefore, the liquid holding ability of the cut surfaces 92*f* and 92*g* becomes higher than that of the mold contact surface 92*e*. Accordingly, considering the "surface roughness" or the measurement by the "θ/2" method, in the cleaning blade 92*a*, the cut surfaces 92*f* and 92*g* easily hold the liquid developer and the mold contact surface 92*e* allows the liquid developer to easily flow thereon.

Figure 12A:
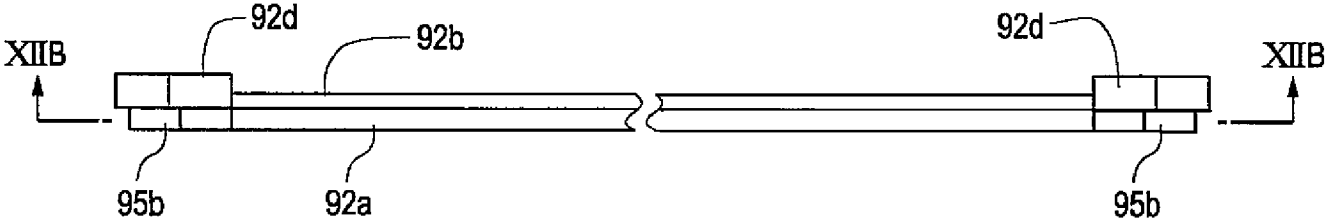
FIG. 12A is a top view of the cleaning device of Embodiment 1.
Figure 12B:
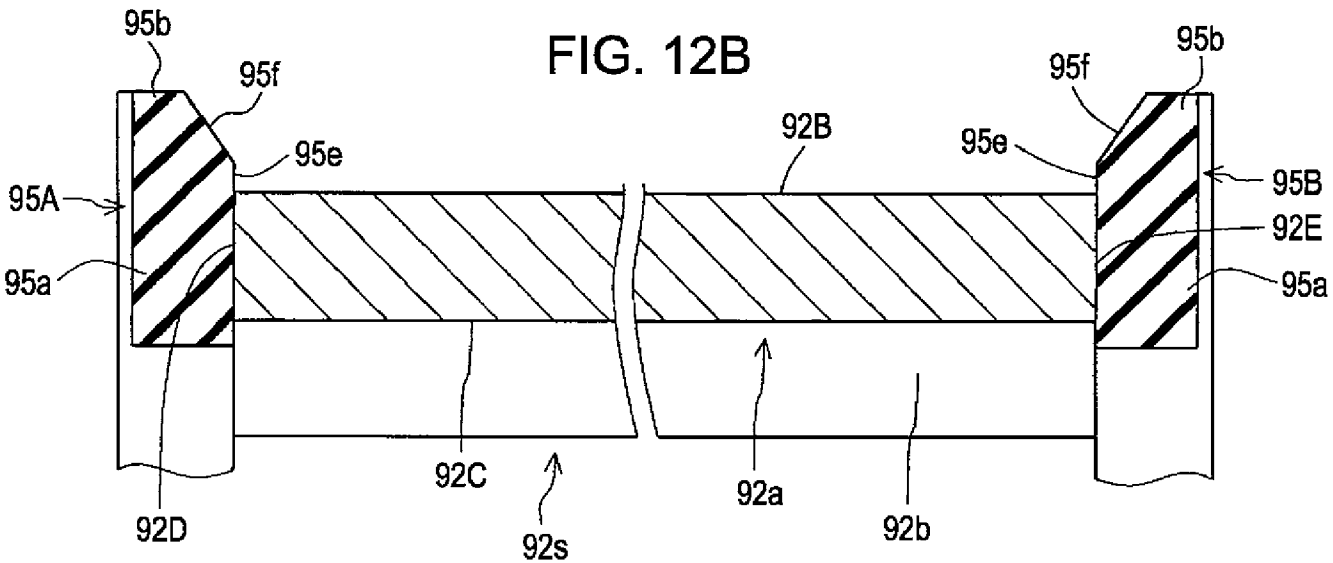
FIG. 12B is a cross-sectional view taken along line XIIB-XIIB of FIG. 12A.

As shown in FIG. 11, a surface (a surface being in an inside and outside relationship, and hereinafter referred to as an "opposite surface") 92*h* on the side opposite to the mold contact surface 92*e* of the cleaning blade 92*a* constitutes a specific example of a "first surface 92A", and one side cut surface 92*f* (the cut surface 92*f* shown on the upper side in FIG. 11) constitutes a specific example of a "second surface 92B". Further, a contact corner portion 92K is constituted by a corner portion (a portion at which two surfaces are joined) formed at the intersection of the first surface 92A and the second surface 92B. Also, in this embodiment, the first surface 92A and the second surface 92B are in a state where they cross each other approximately at right angles. Further, in this embodiment, the other side cut surface 92*g* constitutes a specific example of a "third surface 92C". Also, as shown in FIG. 12B, the surfaces located on one end side and the other end side of the contact corner portion 92K are a fourth surface 92D and a fifth surface 92E and the remaining surface (that is, the mold contact surface 92*e*) is a sixth surface.

Figure 13:
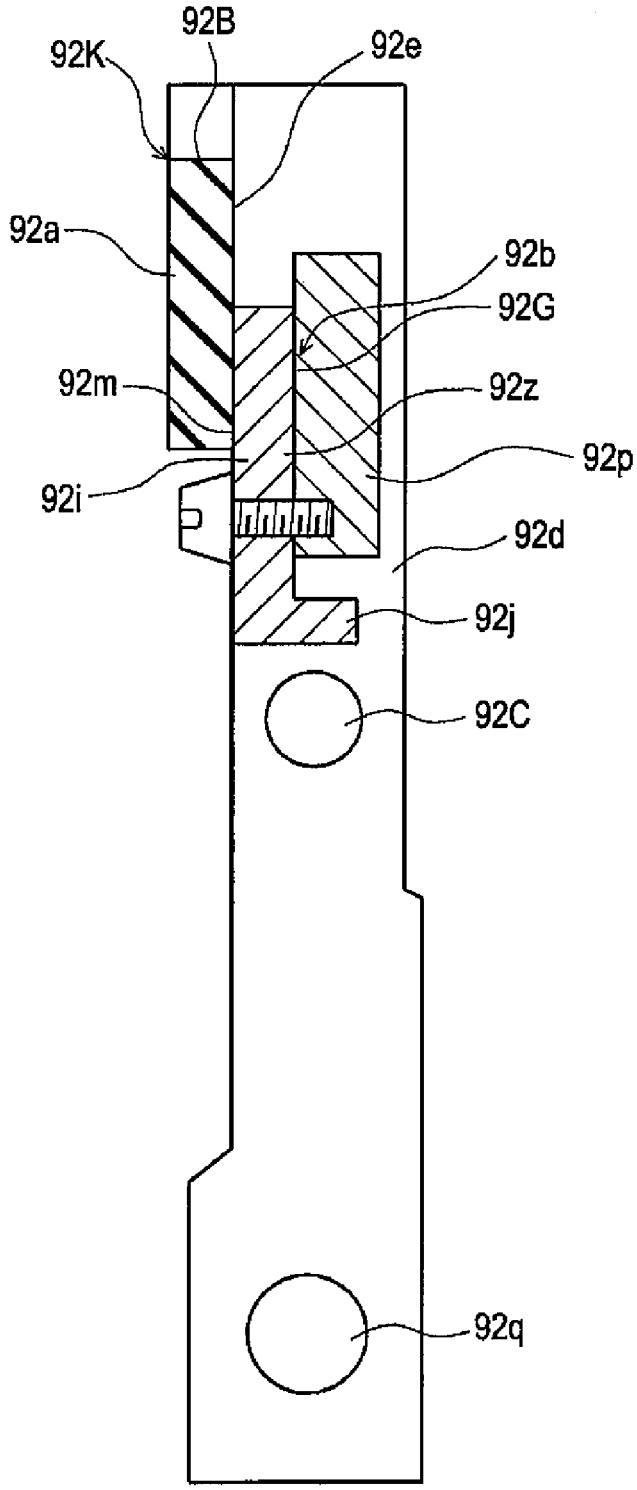
FIG. 13 is a cross-sectional view taken along line XIII-XIII of FIG. 10.

The cleaning blade supporting plate 92*b* is a plate of an approximately L-shape in a longitudinal section, as shown in FIG. 13. The cleaning blade supporting plate 92*b* has a support main body portion 92*i* constituted of an elongated plate-like body, and a return portion 92*j* which is bent and projects from one end (the lower end in FIG. 10) along the short side direction of the support main body portion 92*i*. Also, the surface on the side opposite to the projecting direction of the return portion 92*j* in the support main body portion 92*i* becomes a support surface 92*m* for the cleaning blade 92*a*. Also, in the following explanation, the surface (the surface being in an inside and outside relationship) on the side opposite to the support surface 92*m* in the cleaning blade supporting plate 92*b* is referred to as a held surface 92G.

Here, in a case where the support surface 92*m* and the mold contact surface 92*e* with the second surface 92B disposed on the upper side are facing each other with their longitudinal directions disposed in a lateral direction, the region located on the upper end side of the support surface 92*m* is bonded to the region located on the lower end side of the mold contact surface 92*e*, so that the cleaning blade 92*a* and the cleaning blade supporting plate 92*b* are integrated. When the integrated matter is viewed from the front of the front surface of the cleaning blade 92*a*, there is in a state in which the contact corner portion 92K and the second surface 92B are disposed on the upper side and the cleaning blade supporting plate 92*b* is disposed behind the cleaning blade 92*a*.

The cleaning frames 92*d* and 92*d* support both ends along the longitudinal direction of the integrated matter of the cleaning blade 92*a* and the cleaning blade supporting plate 92*b*, as shown in FIG. 9. That is, both cleaning frames 92*d* and

92*d* constitute rocking arms when rocking the integrated matter of the cleaning blade 92*a* and the cleaning blade supporting plate 92*b* so that the cleaning blade 92*a* is brought into contact with or separated from the secondary transferring roller 91. Further, in this embodiment, the cleaning blade 92*a* and the cleaning blade supporting plate 92*b* are arranged such that their longitudinal directions are disposed in a lateral direction, and the cleaning frames 92*d* and 92*d* are arranged such that their longitudinal directions are disposed in a vertical direction.

As shown in FIGS. 9 and 13, one side ends (arm end sides) along the longitudinal direction of the cleaning frames 92*d* and 92*d* have the function of holding the cleaning blade supporting plate 92*b*. That is, as shown in FIGS. 10 and 13, on one end along the longitudinal direction of the held surface 92G of the cleaning blade supporting plate 92*b*, a holding portion 92*p* of the cleaning frame 92*d* of one side is mounted in a contacted state, and on the other end along the longitudinal direction of the held surface 92G, a holding portion 92*p* of the cleaning frame 92*d* of the other side is mounted in a contacted state. Further, in each end along the longitudinal direction of the cleaning blade supporting plate 92*b*, the cleaning blade supporting plate 92*b* is fixed to the corresponding one of the cleaning frames 92*d* and 92*d* by a screw.

The above-mentioned through-hole 92*c* is provided in the intermediate portion along the longitudinal direction of each of the cleaning frames 92*d* and 92*d*. Since the above-mentioned rocking center shaft 110D is inserted into the through-holes 92*c* and 92*c* of the cleaning frames 92*d* and 92*d*, the cleaning device 92 is supported by the secondary transferring frame 110 so as to be able to be rocked.

As shown in FIGS. 9 and 13, a through-hole 92*q* is provided on the other end side along the longitudinal direction of each of the cleaning frames 92*d* and 92*d*. Each of the through-holes 92*q* and 92*q* of both cleaning frames 92*d* and 92*d* non-rotationally supports each end of a support shaft 92*r* (referring to FIGS. 3 and 5, etc.).

The seal members 95A and 95B are mounted on both ends along the longitudinal direction of the cleaning blade 92*a* (the ends along the longitudinal direction of the cleaning blade 92*a* constitute specific examples of the side ends along one direction of the cleaning blade), as shown in FIGS. 9 and 10. That is, the seal members 95A and 95B are respectively disposed on (a) the fourth surface 92D located on one end side (hereinafter simply referred to as "one end side of the cleaning blade 92*a*") along the axial direction of the rocking center shaft 110D, of the cleaning blade 92*a*, and (b) the fifth surface 92E located on the other end side (hereinafter simply referred to as "the other end side of the cleaning blade 92*a*") along the axial direction of the rocking center shaft 110D, of the cleaning blade 92*a*. Each of the seal members 95A and 95B is a single-piece molded article made of resin or rubber and performs the sealing of the region located at each end of the contact corner portion 92K in the cleaning blade 92*a*. Further, the seal member 95A mounted on one end side of the cleaning blade 92*a* and the seal member 95B mounted on the other end side of the cleaning blade 92*a* have mirror-symmetrical shapes.

As shown in FIG. 12B, the seal member 95A is mounted on the fourth surface 92D and has a main body portion 95*a* being in a state where it does not project further than the second surface 92B, and a projecting portion 95*b* being in a State where it projects further than the second surface 92B. Here, the expression "it projects further than the second surface 92B" denotes that it projects in the direction (the upper side direction in the paper surface of FIG. 12B) opposite to the direction of the third surface 92C (the lower side direction in the paper surface of FIG. 12B) with the second surface 92B as a reference. Further, since the main body portion 95*a* and the fourth surface 92D come into surface-contact with each other through an adhesion layer, sealing between the main body portion 95*a* and the fourth surface 92D is secured. Also, the seal member 95B is mounted on the fifth surface 92E. The seal member 95B also has a main body portion 95*a* being in a state where it does not project further than the second surface 92B, and a projecting portion 95*b* being in a state where it projects further than the second surface 92B.

The projecting portions 95*b* and 95*b* of the seal members 95A and 95B have vertical surface portions 95*e* and 95*e* being in a state (mirror-symmetrical state) where they face each other in the axial direction of the rocking center shaft 110D, and inclined surface portions 95*f* and 95*f*. The vertical surface portions 95*e* and 95*e* are in a state where they intersect with the second surface 92B approximately at right angles with their base ends positioned on the second surface 92B side. Also, the inclined surface portions 95*f* and 95*f* constitute inclined surfaces which extend from the projecting end portions of the vertical surface portions 95*e* and 95*e* to the projecting end surfaces of the projecting portions 95*b*. Also, the distance between a pair of inclined surface portions 95*f* and 95*f*, which face each other in the axial direction of the rocking center shaft 110D, is gradually increased with distance from the second surface 92B.

The pressing member 92*y* is constituted of a coil spring and fixed at one end to the approximately central portion along the axial direction of the support shaft 92*r* and at the other end to the approximately central portion along the axial direction of the support shaft 110E which is held between the side plates 110A and 110B constituting the secondary transferring frame 110 (referring to FIGS. 3 and 5, etc.). The approximately central portion along the axial direction of the support shaft 92*r* and the approximately central portion along the axial direction of the support shaft 110E are the regions located at the approximately central portion along the rocking center shaft 110D (the rocking shaft), of the blade supporting body 92*s*. Further, on a virtual plane orthogonal to the approximately central portion along the axial direction of the support shaft 92*r*, the approximately central portion along the axial direction of the support shaft 110E and the approximately central portion along the rocking center shaft 110D (the rocking shaft), of the second surface 92B are located.

Then, since the pressing member 92*y* exerts a biasing force in the direction which closes the distance between the support shafts 92*r* and 110E, a turning force in the direction which approximates one end side along the longitudinal direction of the cleaning frame to the secondary transferring roller 91 is applied to the cleaning frames 92*d* and 92*d*. Accordingly, in the image forming apparatus A, the contact corner portion 92K of the cleaning blade 92*a* is maintained in a state where it is brought into contact with the outer circumferential surface of the secondary transferring roller 91 by the biasing force of the pressing member 92*y*.

Figure 14A:
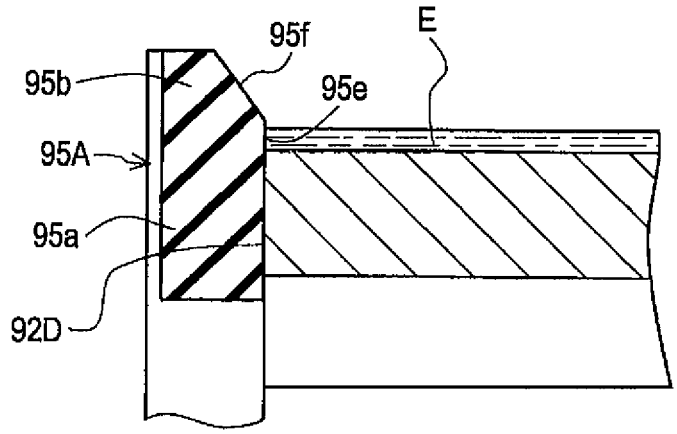
FIGS. 14A, 14B, and 14C are explanatory views for explaining the function of a projecting portion in Embodiment 1.

In the image forming apparatus A, a configuration is adopted in which the contact corner portion 92K of the cleaning blade 92*a* is brought into contact with the outer circumferential surface of the secondary transferring roller 91 by pressing the region of the blade supporting body 92*s*, which is positioned at the approximately central portion along the rocking center shaft 110D (the rocking shaft), by the pressing member 92*y*. In this case, as shown in FIG. 14A, it is planned that the liquid developer E is held in the retention portion which is formed surrounded by the outer circumferential surface of the secondary transferring roller 91 and the second surface 92B which is disposed approximately horizontally.

However, in the image forming apparatus A configured as in this embodiment, if variation within tolerance occurs in the mounting position of the pressing member 92*y* to the blade supporting body 92*s*, the pressing member 92*y* may press the position slightly deviated from the approximately central portion along the rocking center shaft 110D, of the blade supporting body 92*s* to one end side or the other end side of the rocking center shaft 110D. In this case, as shown in FIG. 14B, unforeseen inclination is generated from (i) one end side along the axial direction of the rocking center shaft 110D, of the second surface 92B (hereinafter simply referred to as "one end side of the second surface 92B") toward (ii) the other end side along the axial direction of the rocking center shaft 110D, of the second surface 92B (hereinafter simply referred to as "the other end side of the second surface 92B"), so that the liquid developer E collected in the retention portion which is formed surrounded by the outer circumferential surface of the secondary transferring roller 91 and the second surface 92B may be possibly biased to and distributed at the region located at one end side or the other end side of the second surface 92B.

In addition, in the image forming apparatus A, members, such as the motor 91M, the contacting mechanism, and the separating mechanism, for applying a load (also including a self-weight) to the secondary transferring frame 110 are intensively mounted on the side plate main body 111B of one side constituting the secondary transferring frame 110. Therefore, inclination as shown in FIG. 14B is generated at the second surface 92B, or the gradient of the inclination may be increased.

The inclination of the second surface 92B may occur in not only a case where the secondary transferring roller 91 is in a contact position, but also a case where it is in a separated position. In particular, in this embodiment, since the cam (not shown) constituting the separating mechanism constitutes a support member for supporting the secondary transferring roller 91 at the position separated from the intermediate transferring belt 80, the inclination occurs easily. Probably, this is because the support member (cam) is disposed only on one end side of the rocking center shaft 110D, so that unbalance may possibly occur in the weight applied to both end sides of the secondary transferring frame 110.

Figure 14B:
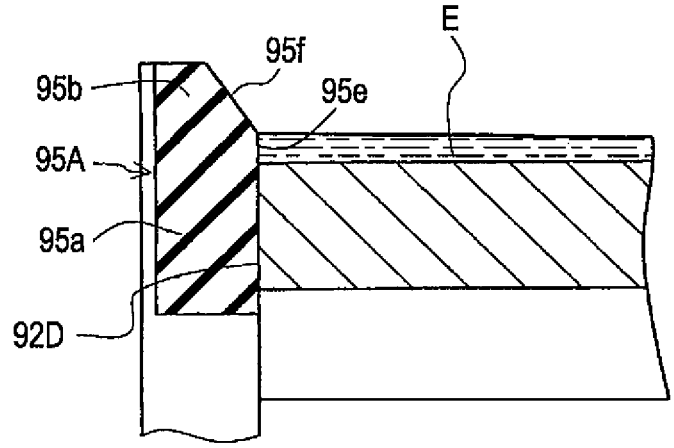

On the contrary, in the image forming apparatus A, as shown in FIG. 14B, the projecting portions 95*b* and 95*b* projecting further than the second surface 92B are provided on both end sides along the rocking center shaft 110D, of the second surface 92B. Therefore, it can be suppressed that the liquid developer E on the second surface 92B (also including the contact corner portion 92K) drops across one side end or the other side end of the contact corner portion 92K.

Figure 14C:
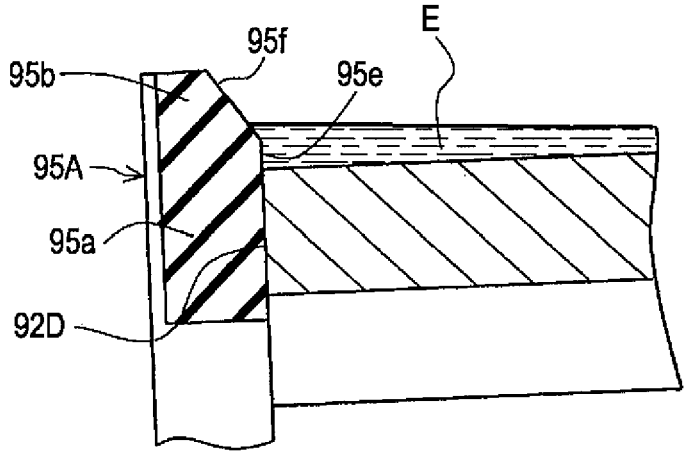

In particular, in this embodiment, since the projecting portions 95*b* and 95*b* provided on both end sides along the rocking center shaft 110D have the inclined surface portions 95*f* and 95*f*, the liquid developer E can be more reliably prevented from dropping across one side end or the other side end of the contact corner portion 92K. Probably, in this embodiment, this is because the second surface 92B and a pair of inclined surface portions 95*f* and 95*f* form an approximately mortar shape in cross section and, as shown in FIG. 14C, if the gradient (angle of inclination) is increased, the liquid developer E retention ability of the region constituted by the second surface 92B and a pair of inclined surface portions 95*f* and 95*f* is increased. However, unlike this embodiment, the surfaces, which face each other in the axial direction of the rocking center shaft 110D, of the projecting portions 95*b* and 95*b* of the seal members 95A and 95B may also be constituted only by the vertical surface portions 95*e* and 95*e*, or only by the inclined surface portions 95*f* and 95*f*.

Figure 15:
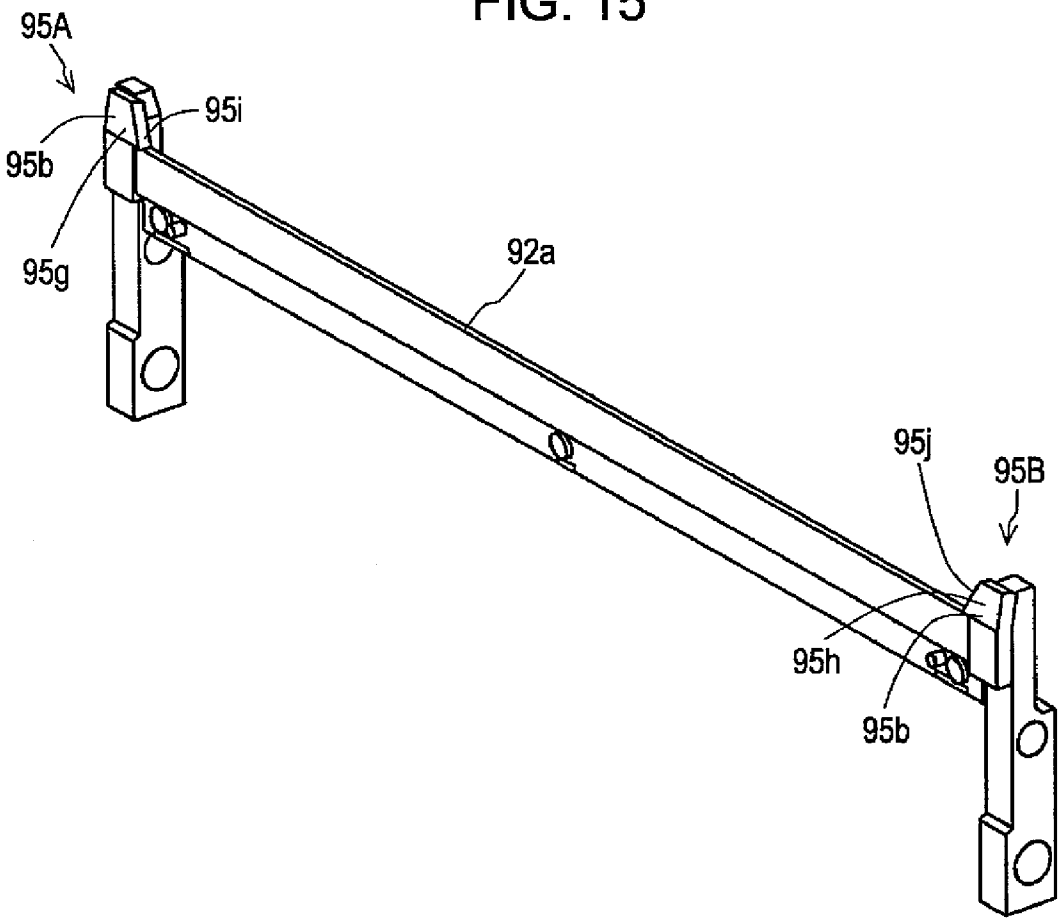
FIG. 15 is a perspective view showing a cleaning device related to a modification example of Embodiment 1.
Figure 16:
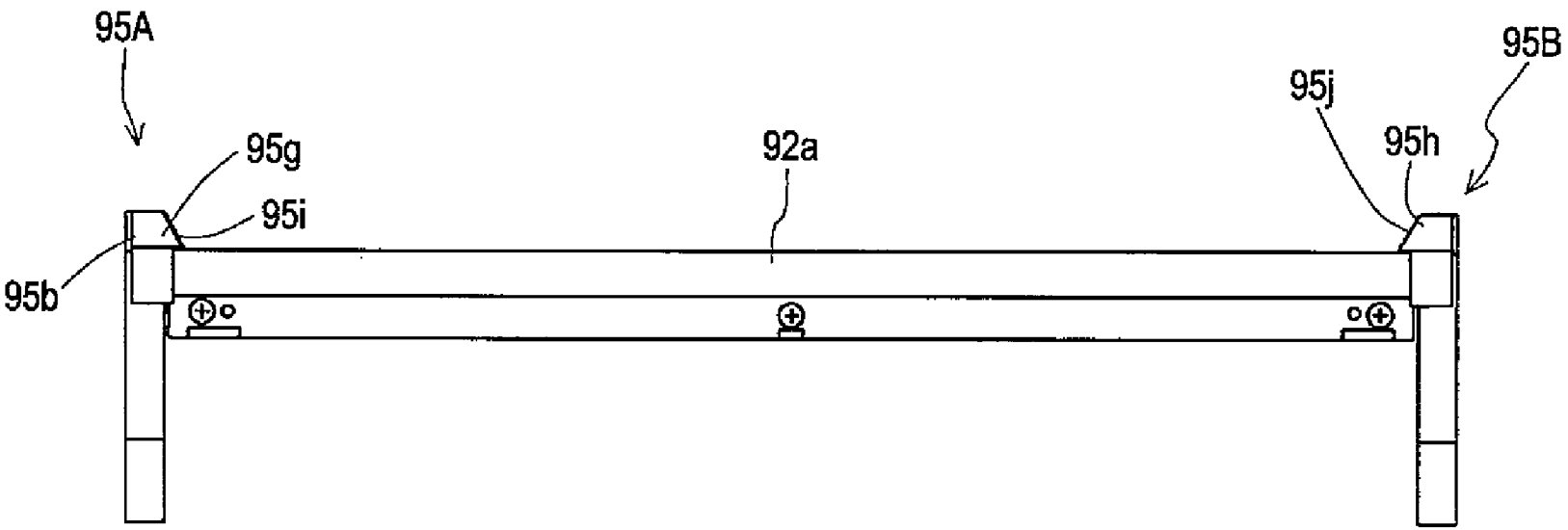
FIG. 16 is a front view showing the cleaning device related to the modification example of Embodiment 1.
Figure 17:
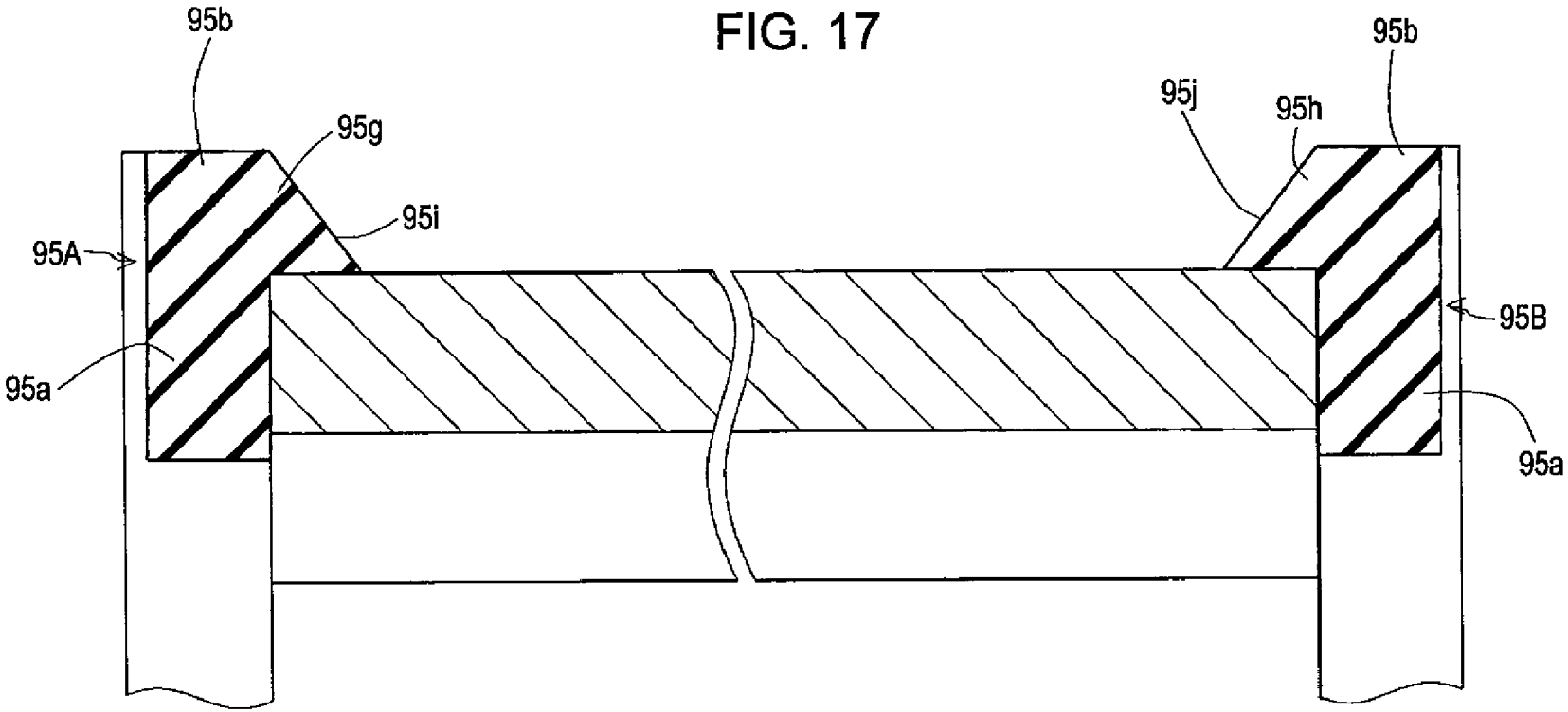
FIG. 17 is a schematic longitudinal sectional view related to the modification example of the cleaning blade.

Next, a modification example of this embodiment is explained with reference to FIGS. 15 and 16. The image forming apparatus related to this modification example is the same as the image forming apparatus A of Embodiment 1 except that the seal members 95A and 95B have extension portions 95*g* and 95*h*. That is, the projecting portion 95*b* of the seal member 95A of one side has the extension portion 95*g* which extends toward the seal member 95B of the other side and covers the end side adjacent to the seal member 95A, of the second surface 92B. Also, the projecting portion 95*b* of the seal member 95B of the other side has the extension portion 95*h* which extends toward the seal member 95A of one side and covers the end side adjacent to the seal member 95B, of the second surface 92B.

Further, the surfaces, which face each other along the rocking center shaft 110D, of the extension portions 95*g* and 95*h* are constituted of inclined surfaces 95*i* and 95*j*. Also in this modification example, an effect similar to that of Embodiment 1 can be obtained. Further, the sealing ability of the end sides of the second surface 92B can be improved by providing an adhesion layer between the extension portions 95*g* and 95*h* and the second surface 92B. Further, in this modification example, the surfaces, which face each other along the rocking center shaft 110D, of the extension portions 95*g* and 95*h* may also be constituted of vertical surface portions, and also, as in Embodiment 1, may also be constituted of vertical surface portions and inclined surface portions.

Embodiment 2

Figure 18:
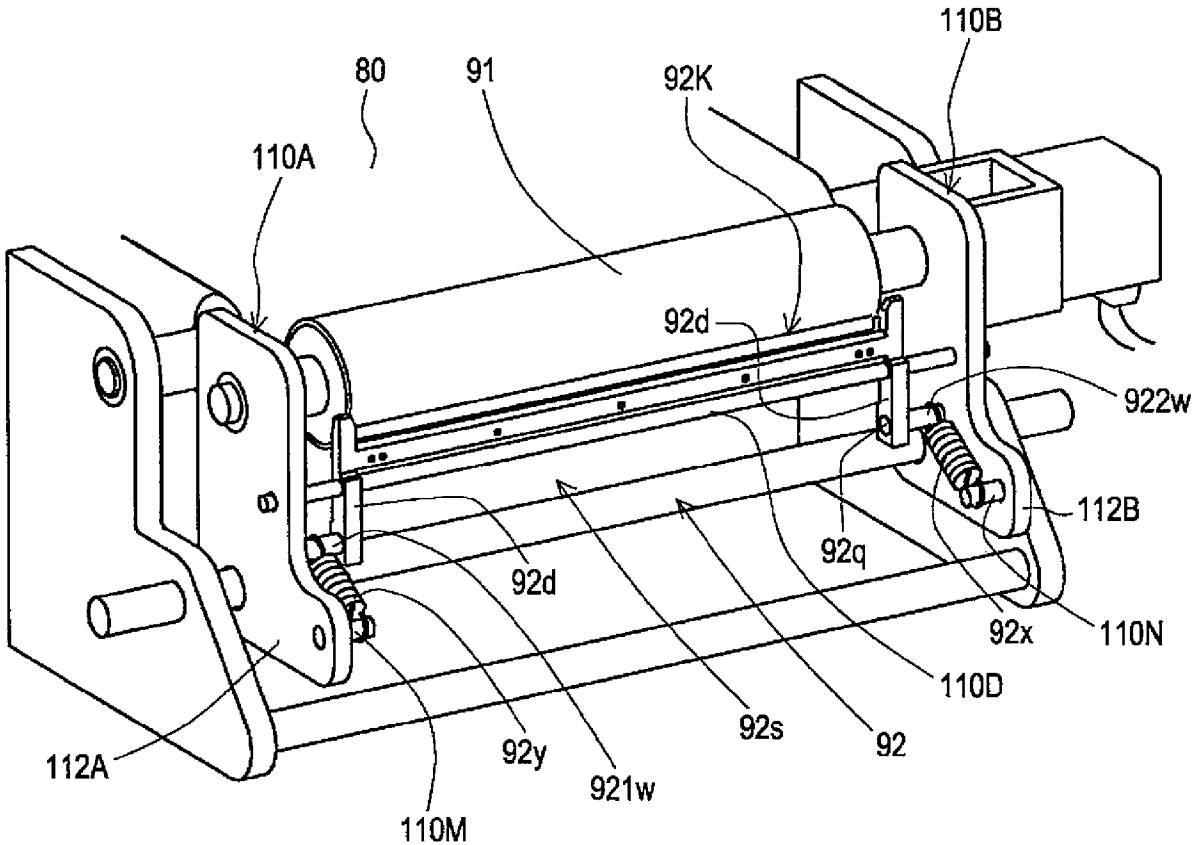
FIG. 18 is a perspective view for explaining the relations among the secondary transferring frame, the transferring frame, the secondary transferring roller, and the cleaning device in Embodiment 2 (the position of the secondary transferring roller is a contact position).

The image forming apparatus of Embodiment 2 is the same as the image forming apparatus A of Embodiment 1 except for the following points. As shown in FIG. 18, this image forming apparatus is different from the image forming apparatus A of Embodiment 1 in that (a) pressing members 92*y* and 92*x* are mounted at the regions located on both end sides along the rocking center shaft 110D, of the blade supporting body 92*s*, (b) cams (not shown) constituting the separating mechanism are disposed on both sides of the secondary transferring frame 110, and (c) the separating mechanisms on both sides of the secondary transferring frame 110 act as separate support members (members which support the secondary transferring frame 110 such that the secondary transferring roller 91 is in the separated position).

That is, in Embodiment 2, the ends of support rods 921*w* and 922*w* are non-rotationally mounted in the through-holes 92*q* and 92*q* of both cleaning frames 92*d* and 92*d*, respectively. That is, the support rods 921*w* and 922*w* are mounted in the through-holes 92*q* of the cleaning frames 92*d* in such a manner that the support rod mounted on the cleaning frame 92*d* of one side projects away from the cleaning frame 92*d* of the other side. Further, a gap is provided between each of the projecting ends of the support rods 921*w* and 922*w* and each of the side plates 110A and 110B located on the projecting sides of the support rods 921*w* and 922*w*.

Further, support rods 110M and 110N are projected from the extension portions 112A and 112B toward the inside of the secondary transferring frame 110 (toward the opposite sides of the extension portions 112A and 112B disposed to face each other). Further, each end of the pressing member 92*y* is fixed to each of the support rods 921*w* and 110M which are located on one end side along the direction of the rocking center shaft 110D, and each end of the pressing member 92*x* is fixed to each of the support rods 922*w* and 110N which are located on the other end side along the direction of the rocking center shaft 110D. In the image forming apparatus of Embodiment 2, the pressing member 92*y* exerts a biasing force in a direction which closes the distance between the support rod 921*w* and the support rod 110M, and the pressing member 92*x* exerts a biasing force in a direction which closes the distance between the support rod 922*w* and the support rod 110N. Therefore, a turning force in the direction which approximates one end side along the longitudinal direction of the cleaning frame to the secondary transferring roller 91 is applied to the cleaning frames 92*d* and 92*d*. Accordingly, in this image forming apparatus, the contact corner portion 92K of the cleaning blade 92*a* is maintained in a state where it is brought into contact with the outer circumferential surface of the secondary transferring roller 91 by the biasing forces of the pressing members 92*y* and 92*x*.

In Embodiment 2, since a configuration is provided in which the biasing members (springs) 92*y* and 92*x* are mounted on both end sides along the rocking shaft center, of the blade supporting body 92*s*, in a case where variation (for example, variation within manufacturing tolerance) occurs in the biasing forces (spring forces) of the biasing members (springs) 92*y* and 92*x*, similarly to Embodiment 1, unforeseen inclination from one end side of the contact corner portion 92K toward the other end side is generated, so that the liquid developer collected in the retention portion which is formed surrounded by the outer circumferential surface of the secondary transferring roller 91 and the second surface 92B may be possibly biased to and distributed at the region located at one end side or the other end side of the contact corner portion in the retention portion.

Also in Embodiment 2, the inclination of the second surface 92B may occur in not only a case where the secondary transferring roller 91 is in a contact position, but also a case where it is in a separated position. Further, in Embodiment 2, cams (not shown) constituting the separating mechanisms are disposed on both sides of the secondary transferring frame 110. However, in a case where variation (for example, variation within manufacture tolerance) has occurred in the sizes of both cams, a case where variation has occurred in the support state of both separating mechanisms, or the like, unbalance may possibly occur in the weight applied to both end sides of the secondary transferring frame 110.

However, also in this embodiment, since the projecting portions 95*b* and 95*b* which project further than the second surface 92B are provided on both end sides along the rocking center shaft 110D, of the second surface 92B, the liquid developer on the second surface 92B (also including the contact corner portion 92K) can be prevented from dropping across one side end or the other side end of the contact corner portion 92K.

Embodiment 3

Figure 19:
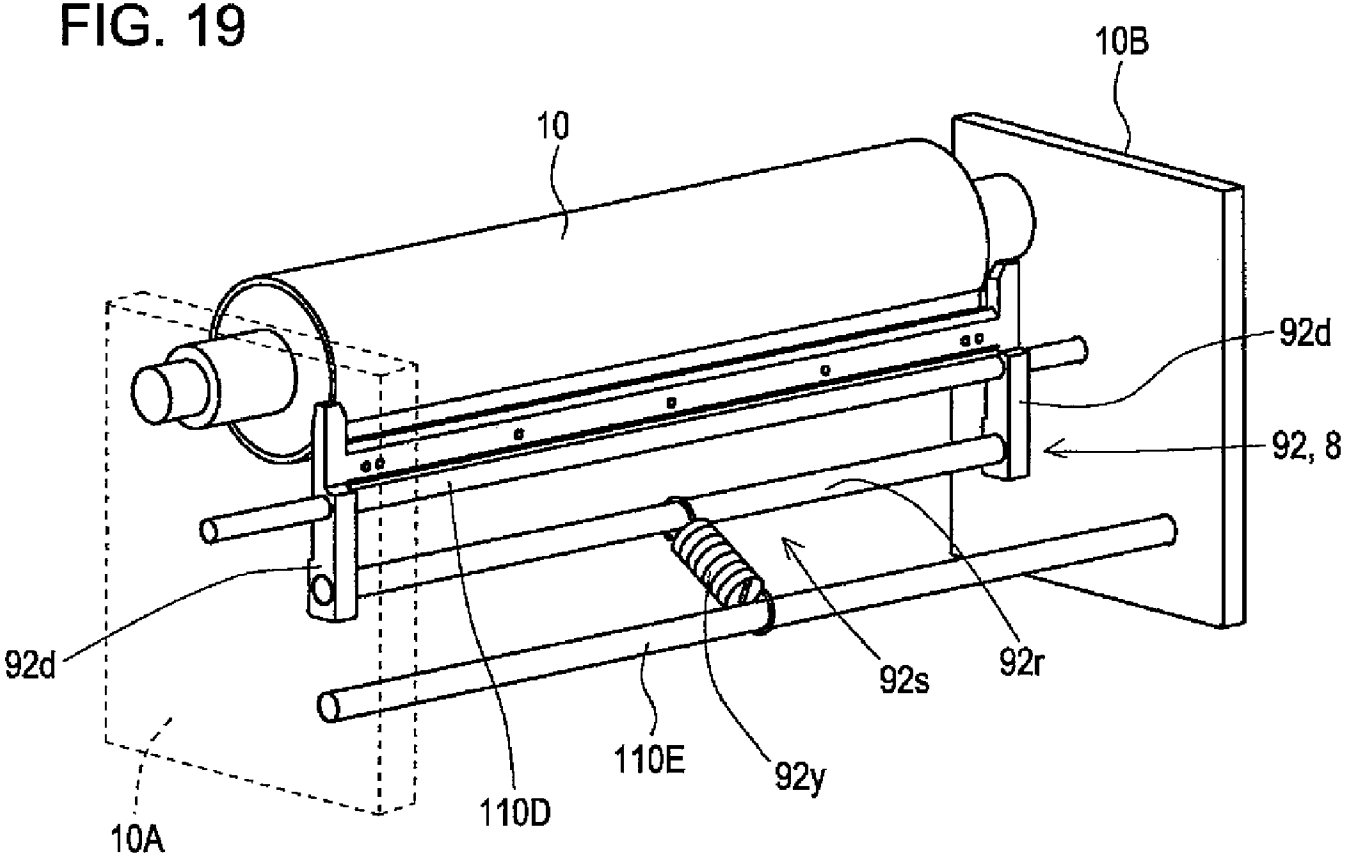
FIG. 19 is a perspective view for explaining a relation between a photo conductor drum and a cleaning device in Embodiment 3.

Embodiment 3 is a specific example of a case where, in the image forming apparatus A of Embodiment 1, an object (a cleaned body) to which the cleaning device 92 is applied is a component other than the secondary transferring roller 91. In Embodiment 3, as shown in FIG. 19, the photo conductor drum 10 is the cleaned body and the cleaning device 8 is constituted by the cleaning device 92 of Embodiment 1.

The photo conductor drum 10 is disposed in a rotatable state between a pair of side plates 10A and 10B which are disposed to face each other. Further, the blade supporting body 92*s* is supported on the side plates 10A and 10B so as to be able to be rocked by the rocking center shaft 110D (rocking shaft). The pressing member 92*y* is mounted between the support shaft 92*r* of the blade supporting body 92*s* and the support shaft 110E spanning between the side plates 10A and 10B. However, the ends of the pressing member 92*y* are attached to the approximately central portion along the axial direction of the support shaft 92*r* and the approximately central portion along the axial direction of the support shaft 110E. Also, since the pressing member 92*y* exerts a biasing force in a direction which closes the distance between the support shafts 92*r* and 110E, a turning force in a direction which approximates one end side along the longitudinal direction of the cleaning frame to the photo conductor drum 10 is applied to the cleaning frames 92*d* and 92*d*. Accordingly, the contact corner portion 92K of the cleaning blade 92*a* is maintained in a state where it is brought into contact with the outer circumferential surface of the photo conductor drum 10 by the biasing force of the pressing member 92*y*.

Figure 20:
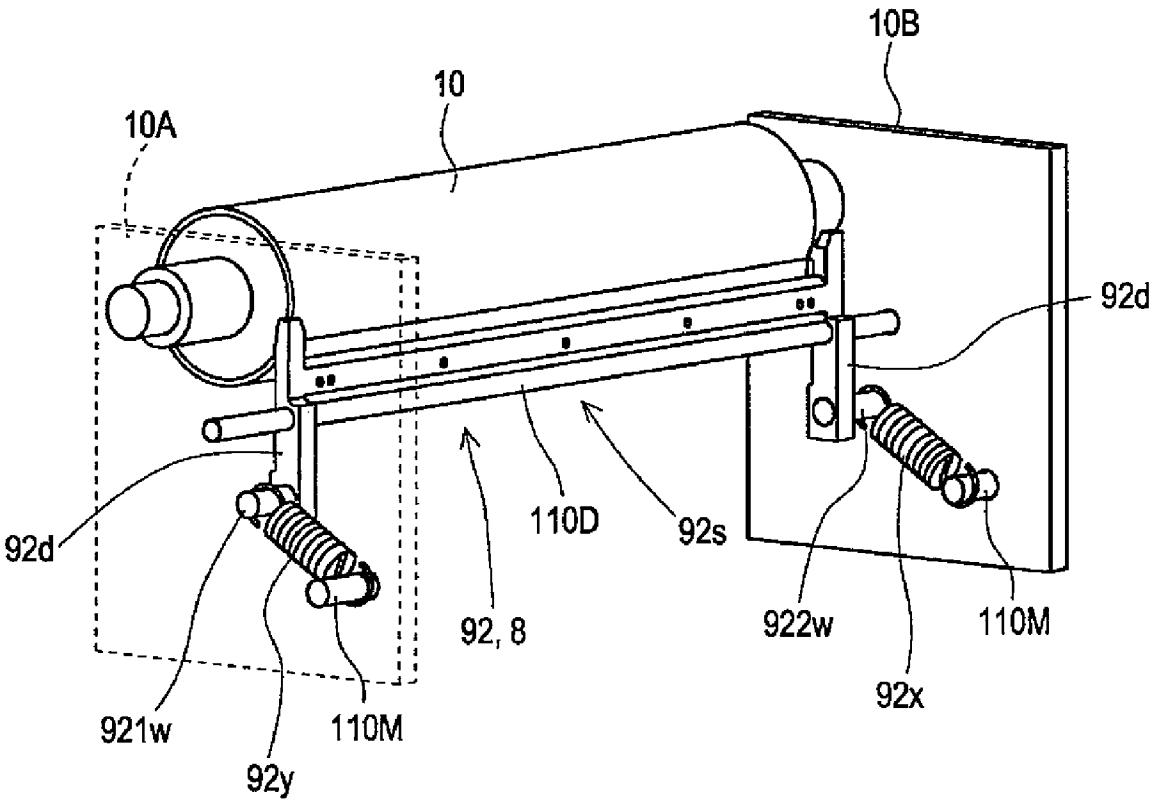
FIG. 20 is a perspective view for explaining a relation between a photo conductor drum and a cleaning device in the modification example of Embodiment 3.

In Embodiment 3, although an object (a cleaned body) to which the cleaning device 92 is applied is different from that in Embodiment 1, an effect similar to that of Embodiment 1 can be obtained. Also, as a modification example of Embodiment 3, the cleaning device 92 shown in FIG. 20 can be given. This modification example also constitutes the modification example of Embodiment 2.

The image forming apparatus of this modification example is different from the image forming apparatus A of Embodiment 3 in that the pressing members 92*y* and 92*x* are mounted at the regions located on both end sides along the rocking center shaft 110D, of the blade supporting body 92*s*. In Embodiment 3, although an object (a cleaned body) to which the cleaning device 92 is applied is different from that of Embodiment 2, an effect similar to that of Embodiment 2 can be obtained.

Also, in each embodiment described above, the application example in which the invention is applied to the cleaning device 92 targeting the secondary transferring roller 91 has been described. However, the invention may also be applied to a cleaning device targeting another roller member constituting the image forming apparatus. For example, the invention may also be applied to a cleaning device targeting the photo conductor squeeze roller 71, or the like.

The invention can be utilized, for example, in a field which carries out the selling, the construction, the processing, and the like of a printer, a copy machine, and a facsimile machine.

The entire disclosure of Japanese Patent Application No: 2008-267150, filed Oct. 16, 2008 is expressly incorporated by reference herein.

What is claimed is:

1. A cleaning device comprising:

a cleaning blade that removes liquid developer including toner particle and carrier liquid by bringing a contact corner portion constituted by a first surface and a second surface into contact with a cleaned body that is rotated or circulated while holding the liquid developer;

a blade supporting body that supports the cleaning blade at the first surface of the cleaning blade or a surface on a side opposite to the first surface;

a pressing member that presses the contact corner portion of the cleaning blade against the cleaned body; and a seal member disposed at a side end in a first direction of the cleaning blade and contacting the side end, and having a projecting portion that projects further than the second surface on a side opposite to a third surface that is on a side opposite to the second surface.

2. The cleaning device according to claim 1, wherein the pressing member presses the blade supporting body at the central portion or the approximately central portion in the first direction of the cleaning blade.

3. The cleaning device according to claim 1, wherein the pressing member presses the blade supporting body at the side end or around the side end in the first direction of the cleaning blade.

4. The cleaning device according to claim 1, wherein the projecting portion of the seal member has a extension portion that extends in the first direction of the second surface from the side end portion of the cleaning blade toward the central portion of the cleaning blade.

5. An image forming apparatus comprising:

an image supporting body that supports an image developed by liquid developer including toner particle and carrier liquid;

a roller member that is brought into contact with or separated from the image supporting body;

a driving source that is connected to one side end portion of the roller member so as to provide a driving force; and a cleaning section having a cleaning blade that removes the liquid developer by bringing a contact corner portion constituted by a first surface and a second surface into contact with the roller member, a blade supporting body that supports the cleaning blade at the first surface of the cleaning blade or a surface on the side opposite to the first surface, a pressing member that presses the contact corner portion of the cleaning blade against the roller member, and a seal member disposed at side end in the first direction of the cleaning blade and contacting the side end, and having a projecting portion that projects further than the second surface on a side opposite to a third surface that is on a side opposite to the second surface.

6. The image forming apparatus according to claim 5, wherein the seal member is disposed on the one end portion side on which the roller member is connected to the driving source.

7. The image forming apparatus according to claim 5, wherein the roller member is a transferring roller which transfers the image supported on the image supporting body to a recording material.

8. An image forming apparatus comprising:

an image supporting body that supports an image developed by liquid developer including toner particles and carrier liquid; and a cleaning section having a cleaning blade that removes the liquid developer by bringing a contact corner portion constituted by a first surface and a second surface into contact with the image supporting body, a blade supporting body that supports the cleaning blade at the first surface of the cleaning blade or a surface on the side opposite to the first surface, a pressing member that presses the contact corner portion of the cleaning blade against the image supporting body, and a seal member disposed at side end in a first direction of the cleaning blade and contacting the side end, and having projecting portions that projects further than the second surface on a side opposite to a third surface that is on a side opposite to the second surface.

* * * * *